US012038203B2

(12) United States Patent
Thébault et al.

(10) Patent No.: US 12,038,203 B2
(45) Date of Patent: Jul. 16, 2024

(54) TRAIN STATION, IN PARTICULAR A TUNNEL-TYPE TRAIN STATION, AND USE OF A FILTER UNIT IN A TRAIN STATION

(71) Applicant: MANN+HUMMEL GmbH, Ludwigsburg (DE)

(72) Inventors: Eric Thébault, Ludwigsburg (DE); Andreas Beck, Kirchheim (DE); Bastian Meister-Magsino, Ludwigsburg (DE); Steffen Kroll, Ludwigsburg (DE); Johannes Stuerner, Aidlingen (DE); Christoph Schulz, Stuttgart (DE); Karlheinz Muenkel, Oberderdingen-Flehingen (DE); Gerrit-Tobias Speidel, Freiberg (DE); Martin Lehmann, Karlsruhe (DE); Andreas Pelz, Kornwestheim (DE); Thilo Mueller, Karlsruhe (DE); Jan-Eric Raschke, Ludwigsburg (DE); Andreas Kloz, Kleinsachsenheim (DE); Gilles Huet, Levallois-Perret (FR); Jérôme Migaud, Vitré (FR)

(73) Assignee: MANN+HUMMEL GmbH, Ludwigsburg (DE)

( * ) Notice: Subject to any disclaimer, the term of this patent is extended or adjusted under 35 U.S.C. 154(b) by 858 days.

(21) Appl. No.: 17/147,070

(22) Filed: Jan. 12, 2021

(65) Prior Publication Data

US 2021/0131685 A1 May 6, 2021

Related U.S. Application Data

(63) Continuation of application No. PCT/EP2019/068889, filed on Jul. 12, 2019.

(30) Foreign Application Priority Data

Jul. 13, 2018 (DE) ..... 102018117034.3
Jul. 13, 2018 (DE) ..... 102018117035.1

(51) Int. Cl.
*B61B 1/02* (2006.01)
*E01B 2/00* (2006.01)
(Continued)

(52) U.S. Cl.
CPC . *F24F 8/10* (2021.01); *B61B 1/02* (2013.01)

(58) Field of Classification Search
CPC . B01D 46/10; B61B 1/02; B61L 27/57; F24F 8/10; E01B 2/003; E04H 3/00; E21F 1/003
(Continued)

(56) References Cited

U.S. PATENT DOCUMENTS 6,500,387 B1 * 12/2002 Bigelow ..... A61L 9/20 55/286
6,773,477 B2 * 8/2004 Lindsay ..... B01D 46/10 55/385.3
(Continued)

FOREIGN PATENT DOCUMENTS

CN 105233688 A 1/2016
CN 107469592 A 12/2017
(Continued)

*Primary Examiner* — Minh Chau T Pham

(57) ABSTRACT

A train station has at least one transportation route for traffic of vehicles, wherein the at least one transportation route is provided with a vehicle tunnel. At least one public waiting area is arranged adjacent to the at least one transportation route. An enclosure is provided in which the at least one public waiting area is arranged, wherein the enclosure has at least one side wall. At least one ambient air purification arrangement for purifying ambient air is provided that has one or more filter units for separating solid, liquid or gaseous ambient air pollutants from the ambient air. The one or more filter units are arranged at and/or in the at least one side wall of the enclosure.

21 Claims, 20 Drawing Sheets

(51) Int. Cl.

| | |
|---|---|
| ***E04H 3/00*** | (2006.01) |
| ***E21F 1/00*** | (2006.01) |
| ***F24F 8/10*** | (2021.01) |

(58) Field of Classification Search
USPC ..... 55/385.1, 385.3
See application file for complete search history.

(56) References Cited

U.S. PATENT DOCUMENTS

| | | | | |
|---|---|---|---|---|
| 8,070,845 | B2 * | 12/2011 | Roehm | B23Q 11/0042 173/71 |
| 9,126,135 | B2 * | 9/2015 | Crabtree | B01D 46/58 |
| 10,143,953 | B1 * | 12/2018 | Lee | A61L 9/12 |

FOREIGN PATENT DOCUMENTS

| | | | | |
|---|---|---|---|---|
| CN | 108167011 | A | 6/2018 | |
| DE | 3826096 | A1 | 2/1990 | |
| FR | 3128130 | A1 * | 12/2021 | B01D 46/10 |
| GB | 2598487 | A * | 3/2022 | B61L 27/57 |
| KR | 20080040305 | A | 5/2005 | |
| KR | 100786782 | B1 | 12/2007 | |
| WO | 2010099748 | A1 | 9/2010 | |
| WO | 2018087068 | A1 | 5/2018 | |

* cited by examiner

TRAIN STATION, IN PARTICULAR A TUNNEL-TYPE TRAIN STATION, AND USE OF A FILTER UNIT IN A TRAIN STATION

CROSS-REFERENCE TO RELATED APPLICATIONS

This application is a continuation application of international application No. PCT/EP2019/068889 having an international filing date of 12 Jul. 2019 and designating the United States, the international application claiming a priority date of 13 Jul. 2018 based on prior filed German patent application No. 10 2018 117 034.3, and further claiming a priority date of 13 Jul. 2018 based on prior filed German patent application No. 10 2018 117 035.1, the entire contents of the aforesaid international application and the aforesaid German patent applications being incorporated herein by reference.

BACKGROUND OF THE INVENTION

The invention concerns a train station with at least one public waiting area for people to wait and at least one transportation route for the traffic of vehicles, wherein the public waiting area is arranged adjacent to the transportation route.

Moreover, the invention concerns a use of a filter unit in a train station.

Train stations are known in general.

KR 100786782 B1 discloses a subway station with an air purification device. Moreover, in WO 18087068 A1, a piece of furniture for air purification is disclosed that, in addition to other placement locations, is suitable also to be placed on a station platform.

Typically, these are train stations that are designed for rail traffic. Rail traffic can include any type of rail-bound means of transportation, such as rapid transit trains (local, regional, and long-distance traffic), subways, and tramways.

The invention is however not limited to such train stations for rail traffic. The mentioned train stations can also be used e.g. for buses, in particular long-distance buses. Aside from rail traffic, long-distance bus connections play an increasingly more important role in many countries, also in Germany. However, stops of long-distance bus connections are mostly not correlated with conventional stops of (e.g. inner-city) bus connections. Instead, separate long-distance bus stations for such long-distance bus connections are provided. These long-distance bus stations are mostly designed similar to conventional train stations of rail traffic.

The invention will however be explained in the following based on the example of a train station for rail traffic.

The invention encompasses expressly above-ground as well as underground train stations, so-called tunnel train stations. The features which are disclosed in the following in regard to the train station are considered to be disclosed also in respect to the tunnel train station and vice versa. Also, advantageous technical effects disclosed in regard to the train station can be transferred to the tunnel train station and vice versa.

The public waiting area of the train station serves persons as a space to stay in the train station. This public waiting area enables persons to wait in the vicinity of the transportation route. On the one hand, the persons can be passengers of vehicles (trains or motor vehicles) that travel through the train station. On the other hand, one must think also of service personnel of the train station operator or personnel of the vehicles. In the example of a train station for rail traffic, the public waiting area will encompass a station platform. This station platform is designed in such applications typically as an island station platform or external station platform. From the public waiting area, the persons have therefore also access to the vehicles which are traveling on the transportation route.

The vehicles (rail vehicles, motor vehicles or the like) which are traveling in the train station reach the train station via the transportation route. They can then interrupt their travel at the public waiting area and can pick up and/or unload persons and/or goods. Subsequently, they can continue their travel and leave the train station again.

Due to the increasing urbanization and the formation of urban agglomerations, in particular the public local, regional, and long-distance passenger transportation becomes more and more important. A continuously increasing throughput of persons and goods must be transported in these cities and urban agglomerations. In this context, train stations are used primarily in the context of public local, regional, and long-distance transportation. The continuously increasing throughput of persons and goods to be transported causes at the same time a continuously increasing traffic in the train stations.

Vehicles that travel in the train stations emit solid, liquid or gaseous substances that contribute to a contamination of the ambient air. In this context, one has to consider, on the one hand, exhaust gases of engines (e.g. internal combustion engines). However, on the other hand, the vehicles produce also emissions of so-called particulate matter when operated. This can be, for example, caused by wear of the brakes of the vehicle during a braking action that is to bring the vehicle to a stop at the public waiting area. Also to be considered is the wear of wheels or tires of the vehicles during travel and during braking. Contact shoes of current collectors that frequently have a wearable coating of carbon material also constitute a further source of emissions.

By introducing limit values, the lawmaker (e.g. German and European) has met concerns in regard to this health hazard for the human body caused by particulate matter. For example, in the European Union exposure of the body to particulate matter of a diameter of smaller than 10 μm to 2.5 μm should not surpass a daily maximum value of 50 $\mu g/m^3$ and an annual average value of 40 $\mu g/m^3$ (so-called $PM_{10}$ value). However, the particulate matter exposure in train stations can surpass multiple times the legally prescribed maximum values. Not least, this is caused in that train stations, also due to their construction, can be vented only with difficulty and (can) provide no effective circulation of the existing ambient air. This applies in particular when the train stations are enclosed by building structures (e.g. train station halls) provided on them that enclose the public waiting area and/or the transportation route at least partially.

SUMMARY OF THE INVENTION

The invention has therefore the object to reduce a contamination of the ambient air in train stations with solid, liquid or gaseous substances without significantly impairing the available space in the public waiting area.

This object is solved by a train station, in particular tunnel train station, with at least one public waiting area for persons to wait and at least one transportation route for the traffic of vehicles, wherein the public waiting area is arranged adjacent to the transportation route, and wherein the train station comprises at least one ambient air purification arrangement for purifying ambient air with at least one filter unit for separating solid, liquid or gaseous ambient air pollutants, in particular particulate matter, from the ambient air, wherein the transportation route is present as a vehicle tunnel and the train station comprises an enclosure in which the public waiting area for persons to wait is arranged, characterized in that the enclosure comprises at least one side wall, wherein the at least one filter unit is arranged at and/or in the side wall of the enclosure.

This object is solved by use of a filter unit for separating solid, liquid or gaseous ambient air pollutants, in particular particulate matter, from the ambient air in a train station with an enclosure that comprises at least one side wall, wherein the at least one filter unit is used at and/or in the side wall of the enclosure.

Further embodiments of the invention can be taken respectively from the dependent claims.

The train station according to the invention comprises an ambient air purification arrangement for purifying an ambient air with at least one filter unit for separating solid, liquid, or gaseous ambient air pollutants, in particular particulate matter, from the ambient air.

Such an ambient air purification arrangement can comprise an active or a passive system. In case of an active system, the ambient air is actively transported, for example, sucked, into the filter unit for purification by means of a suitable device that generates a pressure difference (e.g. blower). In case of a passive system, the ambient air flows by itself through the filter unit due to its own movement. For this purpose, the ambient air purification arrangement or the filter unit can be flowed through at least in a longitudinal direction of the transportation route. However, it is also conceivable that it is flowed through in a transverse direction in relation to the transportation route or another distinguished flow direction of the ambient air (e.g. in or opposite to a direction of gravity).

The arrangement of the ambient air purification arrangement in the train station has the advantage that existing installation space or existing structural elements of the train station must not be modified. The ambient air purification arrangement can be integrated instead into them without great expenditure. The ambient air purification arrangement can be retrofitted into existing train stations. However, it can also be planned and installed from the beginning into train stations that are to be erected.

In this way, the usually very limited available (installation) space in train stations can be optimally utilized. In other respects, possibly unused installation space can be used "expediently". Also, concerns can be appropriately met regarding predetermined safety aspects for protection of persons and management of proper and accident-free traffic operation in the train stations. In this context, the ambient air purification arrangement will be secured also preferably against vandalism and other environmental effects; this is achievable e.g. by its arrangement in the train station, as will be explained below. By using the existing (installation) space that is available or the existing structural elements of the train station, the ambient air purification arrangement can also be accessible easily for a technician for servicing and exchange purposes.

The ambient air purification arrangement comprises at least one filter unit that serves for separating solid, liquid or gaseous ambient air pollutants, in particular particulate matter, from the ambient air. The filter unit can be embodied as one piece or as a multi-part configuration. It can comprise filter elements, for example, filter bellows and/or filter pockets. Also, additional filter sub-elements can be provided that can be connected to a filter element.

The train station can be embodied in particular as a tunnel train station wherein the transportation route is present as a vehicle tunnel and the train station comprises an enclosure in which the public waiting area for persons to wait is arranged.

The enclosure comprises at least one side wall, wherein the filter unit is arranged at and/or in the side wall of the enclosure.

The arrangement of the filter unit at and/or in the side wall has first of all the advantage that it does not limit the mobility of the persons in the public waiting area. This is important in particular at rush hour in the traffic volume when a fast boarding and deboarding of large crowds of people in and out of the vehicles traveling in the tunnel train station must be accomplished.

When arranged at the side wall of the enclosure, the filter unit can be designed e.g. to be freestanding. Here, it will also be provided for its protection from damage and unauthorized access with a housing that is provided with ambient air inlets and outlets. Reference is being had correspondingly to the above description of these features. A length extension of the filter unit can be matched in this context to a height of the side wall of the enclosure. For example, the length extension can have the same height as the side wall. However, here it is also possible that the filter unit is embodied "compact", not "elongate" and/or "areal", as described above. In this case, it can be designed e.g. as a cube. The latter can have similar dimensions as a waste disposal container in the public waiting area (e.g. 90 cm×90 cm×90 cm). Such compact filter units can then be arranged at the side wall (e.g. screwed to the side wall) e.g. at a height that is comfortably accessible by a mechanic or technician; this can be realized either above the floor of the public waiting area or on the floor of the public waiting area.

In principle, the same considerations also apply to a filter unit that is arranged in the side wall of the enclosure. This case is however in particular advantageous because in this way the filter unit can be even farther removed from the floor space of the public waiting area that is usable for persons or other objects and does not obstruct it.

The use of an active filter unit with the above described features can be expedient here.

The side wall of the enclosure can have in particular a curvature in a plane normal to a length extension of the transportation route. Such a curvature results, for example, in tunnel train stations due to the tunnel construction method. The filter unit in this case can have a curvature that corresponds with the curvature of the side wall. The filter unit can be arranged "at" the side wall, i.e., can tightly nestle against the side wall following the curvature, or "in" the side wall, i.e., at least be recessed partially into it. In both cases, an optimal installation space utilization is provided which requires as little space as possible in the public waiting area.

In case of tunnel train stations, the sidewalls are often clad, wherein between a building shell structure and cladding often a considerable gap is existing which advantageously is available as installation space for the filter unit, i.e., in order to arrange the filter unit "in" the side wall or to integrate it in the side wall.

It can be particularly advantageously provided that the filter unit ends flush with a cladding of the side wall whereby advantageously a fully integrated construction is obtained.

According to a preferred embodiment, the filter unit can comprise at least one air inlet opening facing the public waiting area and an air outlet opening facing the public waiting area, wherein the filter unit is supplied with air from the environment via the air inlet opening and purified air is discharged into the environment via the air outlet opening. With this embodiment, it is in particular advantageously possible to purify the air where it is required, namely, in the public waiting area in which persons are otherwise exposed for a longer period of time to harmful pollutant loads.

According to a preferred embodiment, it can be provided that the at least one air outlet opening is positioned above the at least one air inlet opening, which leads to a particularly effective ambient air purification because it is known that the pollutant concentration, in particular particulate matter concentration, is multiple times higher in the lower air layers than in higher air layers. Alternatively or additionally, the air inlet opening can be present in a region of the filter unit that is close to the floor.

In addition, the public waiting area of the train station can be separated by means of a partition device from the transportation route. At least one filter unit is arranged at and/or in the partition device. In this way, advantageously an installation space that is present anyway in train stations with partition devices is utilized for arranging the filter unit, and a particularly effective purification of the public waiting area is enabled because an air exchange or air introduction from the transportation route is reduced to a minimum. In this way, surprisingly a significantly improved air quality in the public waiting area can be provided because the purified air does not mix again with unpurified air from the transportation route.

The partition device can extend across the full height from a surface of a station platform in the public waiting area all the way to the ceiling or enclosure of the train station and thus can completely encapsulate the public waiting area. Alternatively, embodiments of "half the height" are possible in which the partition device extends only to about shoulder height of a person of a predetermined size. The afore described advantageous effect of minimizing the air exchange is however present in both cases.

Preferably, the partition device is embodied as an access control device which comprises at least one access control door or station platform door by means of which the public waiting area in a person exchange state can be opened toward the transportation route.

The partition device or access control device separates the transportation route from the public waiting area. In this way, it can be avoided that persons from the public waiting area can access the transportation route and can be possibly hit by the vehicles. In order for the persons to still be able to board or deboard an available vehicle, the access control device comprises incorporated access control doors (station platform doors) between individual partition elements. As soon as a vehicle has reached its final stop position on the transportation route, these access control doors (and optionally the doors of the vehicle, if present) open and the persons can board or deboard the vehicle. The filter unit can be arranged at and/or in the partition elements of the access control doors, e.g. in the form of flat filter units; an arrangement at and/or in the partition doors is also (additionally) possible.

Here, the use of an active filter unit with the afore described features can be at least in addition expedient in order to increase the separation performance.

According to a preferred embodiment, the partition device can comprise at least one air inlet opening facing the public waiting area and an air outlet opening facing the public waiting area, wherein the filter unit is supplied with air from the environment through the air inlet opening and purified air is discharged through the air outlet opening into the environment. Due to this embodiment, it is in particular advantageously possible to purify the air where it is necessary, namely in the public waiting area in which persons otherwise are exposed for an extended period of time to harmful pollutant loads.

The air volume which is defined and comparatively closed off by the partition device can be purified much more effectively than a complete air volume, for example, of a train station hall or a tunnel train station including transportation route tunnels.

According to a further preferred embodiment, it can be provided that the at least one air outlet opening is positioned above the at least one air inlet opening, which contributes to a particularly effective ambient air purification because it is known that the pollutant concentration, in particular particulate matter concentration, is multiple times higher in lower air layers than in higher air layers. Alternatively or additionally, the air inlet opening can be present in a region of the partition device that is close to the floor.

In this context, it is advantageous that the public waiting area encloses a free space together with the transportation route, wherein the filter unit is arranged in the free space.

Such a free space is present anyway in many train stations. It can be embodied e.g. across a length of a length extension of the public waiting area. It is used e.g. for receiving current-carrying cables, for example, for purposes of electrification of the transportation route. It can be formed, for example, as an overhang of a section of the public waiting area into the transportation route. This overhang can have a U-shaped cross section. This U-shaped cross section can be formed, for example, as a molded concrete part. Since this free space is existing anyway in many train stations, otherwise unused or not completely used installation space can be used expediently (additionally) by the ambient air purification arrangement.

The public waiting area can preferably comprise at least one station platform that extends, for example, parallel to the transportation route, wherein the station platform comprises at least one overhang region which extends at least partially across the free space, wherein the filter unit is arranged in a region of the free space that is delimited by the overhang region. The overhang region can be formed by the aforementioned overhang, for example, by the U-shaped molded concrete part or other station platform overhang carriers.

A further advantage of the arrangement of the filter unit in the free space is that a free outflow zone is provided. There are no further disturbing structures or other components in a flow direction (thus e.g. parallel to a length extension of the public waiting area) downstream of the filter unit. They could cause turbulence of the ambient air which would result in an increased pressure loss that would make difficult or impossible a purely passive operation of the filter unit. The use of a passive filter unit is advantageously possible. However, an improvement of the separation performance can be possibly achieved also by the (additional, as needed) use of an active filter unit.

It is further advantageous that the described arrangement of the filter unit does not infringe the clearance profile of the transportation route. The clearance profile refers in this context to the "clearance space" that is to be kept free from objects on the transportation route. Also, it is protected well against vandalism or other damage by persons because they have typically no access to the filter unit from the public waiting area.

Not least, the arrangement of the filter unit, as here, close to the floor (i.e., in the vicinity of the transportation route) is advantageous. In this way, the filter unit, due to the spatial proximity to the vehicles, is located near the source of the ambient air pollutants. This region will be significantly more strongly loaded with ambient air pollutants compared to other regions of the train station. The efficiency of the ambient air purification arrangement can be increased.

Also, it is advantageous in this context that the free space is closed off by means of a protection device, preferably a protective grid, in relation to the transportation route.

The protection device serves to protect the filter unit. This protection can be necessary, for example, against objects (stones, crushed rock, waste or the like) that are thrown about (e.g. by incoming vehicles). Also, it can be an effective measure against vandalism that could be directed at the filter unit. Not least, the protection device can also serve as a protection against damage of the filter unit by animals. For example, in facilities such as train stations, typically different rodents, e.g. rats, but also birds, e.g. pigeons or ravens, are present. In particular rodents are known to "chew" on various objects and possibly damage them thereby. This is to be avoided here for maintaining the function of the filter unit.

The protection device in a simple configuration can be, for example, a protective grid. The latter can surround the filter unit like a cage and thus shield it with respect to its surroundings. The meshes of this protective grid can be selected to be correspondingly narrow (e.g. a few centimeters or millimeters) in order to keep away animals or humans from the filter unit. In this context, the meshes however are to be selected so large that they affect only insignificantly the outflow zone of the filter unit. In this way, a proper operation of the filter unit is ensured.

The protection device can be retrofitted at the filter unit and in particular can be made available inexpensively.

In all of this, it is advantageous that the train station comprises a column-shaped structural element in the public waiting area which is preferably designed as a seat for persons wherein the filter unit is arranged in the column-shaped structural component.

The column-shaped structural element can be arranged e.g. freestanding in the public waiting area. An access to the filter unit for purposes of servicing or exchange of components is possible easily for a technician.

The column-shaped structural element in this context can fulfill, in addition to the actual function as part of the ambient air purification arrangement, also other functions. One of these functions can be that of a seat for persons which are present in the public waiting area and e.g. are waiting for a vehicle. For this purpose, the column-shaped structural element is arranged e.g. in its length direction (horizontally) on the floor of the public waiting area at a certain location. The column-shaped structural element will have a housing that provides corresponding seats for persons at its exterior side. The filter unit will then be located in the interior of the housing of this column-shaped structural component. In this way, it is ensured that the filter unit, on the one hand, is protected from unauthorized access (damage by animals or humans). On the other hand, at least one ambient air inlet (through which the ambient air to be purified flows into the filter unit) and at least one ambient air outlet (through which the purified ambient air flows out of the filter unit) will be provided at the column-shaped structural element. In this context, it can be expedient to operate the filter unit at least additionally as an active system in order to ensure a corresponding sufficient ambient air throughput through the column-shaped structural component.

On the other hand, the column-shaped structural element can also be arranged in a vertical position (its length direction is positioned in a vertical relative to the direction of gravity). In this orientation, the arrangement of the filter unit (in the interior of the housing) and the above-described associated construction features (ambient air inlet, outlet etc.) with the same function will be provided in a similar way. However, the column-shaped structural component then no longer serves as a seat. However, if needed, other functions can be taken on. For example, an advertisement column, signaling device, or multimedia device (e.g. for projections of information in regard to the traffic operation or advertisement messages) are conceivable.

It is preferred that the train station comprises at least one enclosure structure, preferably a roof structure which at least partially encloses the public waiting area and/or the transportation route, wherein the filter unit is arranged at the enclosure structure.

The arrangement of the filter unit at the enclosure structure has initially the advantage that it does not limit the mobility of the persons in the public waiting area. This is in particular important during rush hour in the traffic volume when a fast boarding and deboarding of large crowds of people in and out of the vehicles traveling in the train stations must be managed.

When arranged at the enclosure structure (e.g. at a steel or concrete support of the roof construction and/or at the roof construction), the filter unit can be embodied e.g. to be freestanding. Here, it will also comprise a housing as a protection from damage and unauthorized access that is provided with ambient air inlets and ambient air outlets. Reference is being had to the above description of these features. It is possible that the filter unit is of a "compact" configuration. In this case, it can be designed e.g. as a cube. It can have similar dimensions as a waste disposal container in the public waiting area (e.g. 90 cm×90 cm×90 cm). Such compact filter units can then be arranged at the enclosure structure, e.g. at a height that is easily accessible for a mechanic or technician (e.g. welded or screwed to the enclosure structure such as a steel or concrete support); this can be done either above the floor of the public waiting area or on the floor of the public waiting area.

Here, the use of an active filter unit with the afore described features can be expedient.

Not least, it is preferred that the train station comprises at least one multimedia device, in particular a display panel, a signal device, a display or advertisement case and/or at least one vending machine or another train station operational device wherein the filter unit is arranged at the multimedia device and/or the vending machine and/or the other train station operational device.

Such multimedia devices can be found in many modern train stations. They are arranged, for example, suspended from the enclosure structure. However, they can also be arranged freestanding in the public waiting area.

A multimedia device is understood herein e.g. as a display panel. Such display panels enable displaying actual (changing) information, e.g. in relation to the schedule of vehicles in the train station, important information regarding the departure times of the vehicles, a map of the transportation routes or other information (such as shutdown of (partial) sections of a transportation route or safety information). Also, a multimedia device can be understood as a signal device. A signal device can be, for example, a light signal device for the vehicles traveling in the train station; likewise, a public announcement device for announcing information (e.g. regarding the traffic situation or for persons in the public waiting area) can be intended. Display or advertisement cases are typically arranged freestanding in the public waiting area. They contain, for example, advertisements (e.g. for cultural events) but also schedules or other information in regard to the operation of the train station. Vending machines can also be arranged freestanding in the public waiting area. Vending machines comprise in this context goods vending machines for buying drinks and/or food as well as ticket vending machines for obtaining tickets for using the vehicles that are traveling in the train station. Other train station operational devices comprise all devices that belong to the operation of the train station, e.g. sales booths, such as a kiosks, sales booths for tickets, signposts, elevator structures etc.

The structural elements and structures existing in the train station can be used in addition to their actual function, additionally as attachment locations of the filter unit. Existing structures are thus expediently utilized additionally by the ambient air purification arrangement.

Here, the use of an active filter unit with the afore described features can be expedient.

In this context, it is also advantageous that the train station comprises a stairway, preferably a self-supporting stairway, and/or an escalator wherein the filter unit is arranged at the stairway and/or at the escalator, preferably in a region between two neighboring escalators and/or below a self-supporting stairway.

The stairway and the escalator (moving stairway) serve in this context to enable persons to access and leave the public waiting area. The stairways and escalators can either guide the persons out of the train station or can enable change to a different public waiting area (and a different transportation route) of the same train station. Stairways or escalators comprise in general sufficient available free installation space that enables arrangement of the filter unit. In particular underneath a self-supporting stairway and/or in the separation region between two escalators (optionally running in opposite directions), there is such installation space available that is often unused otherwise. The filter units can be retrofitted here correspondingly without great expenditure. Here, the use of an active filter unit with the afore described features can be expedient.

It is also advantageous that the train station comprises at least one structural element for increasing comfort of the stay of persons in the train station, in particular a seat such as a chair, a bench, and the like and a waste disposal container, wherein the filter unit is arranged at the structural element, preferably at the seat and/or at the waste disposal container.

Structural elements for improving comfort of the stay of persons in the train station are in particular seats. They can comprise a chair, a bench, sit stand or similar elements that are usually fixedly connected to the train station. These elements can be arranged freestanding in the public waiting area. At such seats, there is usually free installation space available in which the filter unit can be arranged. Here, one can think of free installation space e.g. below the benches and the chairs.

The comfort of persons can also be improved by a clean train station. Accordingly, the waste disposal containers, such as trash cans, belong to the aforementioned elements. At these waste disposal containers that can be arranged freestanding in the public waiting area, there is usually also sufficient installation space for an unhindered attachment of the filter unit available. Below the waste disposal containers there is usually sufficient installation space available for the arrangement of a filter unit. This applies in particular to such waste disposal containers that are arranged at a side wall of the enclosure above the floor of the public waiting area.

Not least, it is advantageous that the transportation route comprises at least one track-guiding element wherein the filter unit is arranged on the transportation route, preferably between two neighboring track-guiding elements and/or in an intermediate space between two pairs of track-guiding elements.

A track-guiding element can be, for example, a rail. Rail vehicles such as rapid transit trains, subways or tramways are guided on rails. In this context, usually at least two track-guiding elements (a pair of rails) are positioned at a fixed predetermined distance (so-called track gauge) are spaced apart from each other spatially. Accordingly, between two such track-guiding elements, spaced apart at a fixed distance from each other, a free installation space is available. The latter can be used for the arrangement of the filter unit. Such an arrangement is in turn advantageous because it is in direct vicinity to the source of the ambient air pollutants. On the other hand, in train stations also the situation is encountered that two neighboring track-guiding elements (the first rail pair) is arranged adjacent to two further track-guiding elements (the second rail pair). In this case, a space between the two pairs of track-guiding elements can remain free of further structural elements. This free (installation) space can then also be utilized for the arrangement of a filter unit.

For the purpose of increasing the separation performance of the filter unit, it can be embodied in both described embodiments as an active system.

In this context, it is advantageous that the public waiting area has a hollow space, in particular a cable guiding channel and/or venting channel, wherein the filter unit is arranged in the hollow space. Such channels are typically provided in train stations for guiding conduits and (electric) cables or as venting channels e.g. of an air conditioning device. In this context, these channels can extend within the public waiting area. They can be accessible via the public waiting area e.g via a grid. Within such a hollow space in the public waiting area, the filter unit can be arranged. Ambient air from the public waiting area can be sucked in e.g. by an active filter unit and purified from the ambient air pollutants. In this context, it is then in particular advantageous that the filter unit is protected from access by unauthorized persons and vandalism in the hollow space. Existing installation space structures can be utilized expediently by the ambient air purification arrangement.

Also, it is advantageous that the ambient air purification arrangement comprises at least one pre-separator or coarse separator upstream thereof, in particular, a separation grid, separation net, baffle plate and/or a preseparation nonwoven.

The pre-separator or coarse separator is in particular provided to prevent that foreign bodies can enter the filter unit. Due to the kinetic energy with which the foreign bodies would enter the filter unit, the filter unit could become damaged. The train stations according to the invention are often dirty, at least in large cities and urban agglomerations, in the transportation routes and the public waiting areas, e.g. by waste lying around and similar macroscopic pollutants. These pollutants can be thrown about easily, e.g. by the formation of turbulence in the ambient air by an incoming vehicle and, by a subsequent collision with the filter unit, can damage the latter. The preseparator or coarse separator can therefore be provided with a large mesh separation grid, that e.g. has a mesh width of 1 mm to 4 mm, preferably 6 mm to 8 mm. Entry of macroscopic pollutants into the filter unit is prevented. By attachment of a pre-separator or coarse separator, only a negligibly small additional pressure loss is provided; the operation of the filter unit as a passive system remains possible. Such grids are inexpensively available e.g. as expanded aluminum. A preseparation nonwoven can in particular also take on a filtering function.

It is advantageous in this context that the ambient air purification arrangement comprises at least one water separator for separating water, in particular rainwater, arranged upstream, preferably upstream or downstream of the pre-separator or coarse separator.

Many train stations are in the open despite the partially existing enclosure structure. This applies in particular also for at least some sections of the transportation route. In particular, these partial areas of the train station are exposed to environmental and weather effects, e.g. rain. In addition, however, the public waiting area must be cleaned from time to time. In this context, cleaning water or similar cleaning liquids can be used also. In this context, it cannot be excluded that splashing water comes into contact with the filter unit.

The water separator can preferably comprise a slat separator and/or a hydrophobic, in particular hydrophobically impregnated, separation layer, and/or in particular closable flaps or slats. The water separator can be switched on or positioned in the flow path, in particular depending on a rain sensor signal of the ambient air purification device. In case of closable flaps or slats, they can be adjusted depending on a rain sensor signal.

It is to be considered advantageous that the ambient air purification arrangement comprises a sensor device that is designed to detect a vehicle that enters or leaves the train station and/or a degree of ambient air contamination.

The presence of a vehicle (entering and/or leaving) in the train station is detectable by the sensor device. Likewise, a degree of ambient air contamination. The presence of a vehicle in the train station, as described, will increase the ambient air contamination in the train station. This vehicle forms inter alia a source of the ambient air contamination. The presence of this source or the already existing degree of ambient air contamination are thus important parameters for the operation of the ambient air purification arrangement. As a function of these parameters, for example, an active operation can be switched on in addition to a passive operation of the ambient air purification arrangement. This can be done, for example, when a vehicle enters the train station or a certain limit value of the ambient air contamination is surpassed. The separation performance of the filter unit can be increased.

In this context, it is finally advantageous that the sensor device is designed to activate or deactivate the filter unit as a function of an occurrence of a predetermined event.

This predetermined event can be, for example, a vehicle entering the train station (detected by means of the sensor device). It can also be surpassing a predetermined limit value of the ambient air contamination (detected by means of the sensor unit). Also, it is possible that the filter unit is activated as a function of the time of day, e.g. after the train station is closed and prior to opening the train station to the public.

Activation and deactivation can refer to an active operation of the filter unit. Thus, the separation performance of the filter unit can be controlled and optimized as a function of certain events. According to a further embodiment, the predetermined event includes the issuance of a public announcement by loudspeaker. For safety reasons, an active ambient air purification arrangement, i.e., provided with blower, may not be operated during a public announcement by loudspeaker in order not to impair understanding of the public announcement due to an acoustic influence.

The expression "arranged" in all embodiments of the present specification and the accompanying claims can encompass the meaning that the filter unit is fastened to the structural elements that are referenced or other features. Such attachment can be done, for example, by riveting, screwing, welding etc.

An arrangement "at" the aforementioned structural elements is to be understood such that, in the aforementioned meaning, they are arranged, or connected to them, above, below, at a side of, on and/or in them.

Moreover, the following embodiments in the context of the present invention can be claimed:

Embodiment 1

Train station with at least one public waiting area for persons to wait and at least one transportation route for the traffic of vehicles, wherein the public waiting area is arranged adjacent to the transportation route, characterized in that the train station comprises an ambient air purification arrangement for purifying an ambient air with at least one filter unit for separating solid, liquid or gaseous ambient air pollutants, in particular particulate matter, from the ambient air.

Embodiment 2

Train station according to embodiment 1, wherein the public waiting area encloses a free space with the transportation route, wherein the filter unit is arranged in the free space.

Embodiment 3

Train station according to embodiment 2, wherein the public waiting area comprises at least one station platform that extends in particular parallel to the transportation route, wherein the station platform comprises at least one overhang region that at least partially extends across the free space, wherein the filter unit is arranged in a region of the free space that is delimited by the overhang region.

Embodiment 4

Train station according to embodiment 2 or 3, wherein the free space is closed off by means of a protection device, preferably a protective grid, with respect to the transportation route.

Embodiment 5

Train station according to one of the embodiments 1 to 4, wherein the train station comprises a column-shaped structural element in the public waiting area that preferably is designed as a seat for persons, wherein the filter unit is arranged in the column-shaped structural element.

Embodiment 6

Train station according to one of the embodiments 1 to 5, wherein the train station comprises at least one enclosure structure, preferably a roof construction, which at least partially encloses the public waiting area and/or the transportation route, wherein the filter unit is arranged at the enclosure structure.

Embodiment 7

Train station according to one of the embodiments 1 to 6, wherein the train station comprises at least one multimedia device, in particular a display panel, a signal device, a display or advertisement case, and/or at least one vending machine or another train station operational device, wherein the filter unit is arranged at the multimedia device and/or the vending machine and/or the other train station operational device.

Embodiment 8

Train station according to one of the embodiments 1 to 7, wherein the train station comprises a stairway, preferably a self-supporting stairway, and/or an escalator, wherein the filter unit is arranged at the stairway and/or at the escalator, preferably in a region between two neighboring escalators and/or below a self-supporting stairway.

Embodiment 9

Train station according to one of the embodiments 1 to 8, wherein the public waiting area is separated by means of a partition device from the transportation route, wherein the filter unit is arranged at and/or in the partition device.

Embodiment 10

Train station according to one of the embodiments 1 to 9, wherein the train station comprises at least one structural element for increasing comfort of the stay of persons in the train station, in particular a seat, such as a chair, a bench and the like, and a waste disposal container, wherein the filter unit is arranged at the structural element, preferably at the seat and/or at the waste disposal container.

Embodiment 11

Train station according to one of the embodiments 1 to 10, wherein the transportation route comprises at least one track-guiding element, wherein the filter unit is arranged on the transportation route, preferably between two neighboring track-guiding elements and/or in an intermediate space between two pairs of track-guiding elements.

Embodiment 12

Train station according to one of the embodiments 1 to 11, wherein the public waiting area comprises a hollow space, in particular a cable guiding channel and/or venting channel, wherein the filter unit is arranged in the hollow space.

Embodiment 13

Train station according to one of the embodiments 1 to 12, wherein the ambient air purification arrangement comprises at least one pre-separator or coarse separator upstream of the filter unit, in particular a separation grid, separation net, baffle plate and/or a pre-separator nonwoven.

Embodiment 14

Train station according to embodiment 13, wherein the ambient air purification arrangement comprises at least one water separator for separating water, in particular rainwater, arranged upstream of the filter unit, preferably upstream or downstream of the pre-separator or coarse separator.

Embodiment 15

Train station according to one of the embodiments 1 to 14, wherein the ambient air purification arrangement comprises a sensor device that is configured to detect a vehicle entering or leaving the train station and/or a degree of ambient air contamination.

Embodiment 16

Train station according to embodiment 15, wherein the sensor device is configured to activate or deactivate the filter unit as a function of an occurrence of a predetermined event, in particular a vehicle entering or leaving the vehicle tunnel and/or a degree of ambient air contamination.

According to some embodiments, the train station can be a tunnel train station. All features disclosed in regard to the train station are also considered as disclosed in regard to the tunnel train station and vice versa.

The tunnel train station according to the invention can be in particular claimed in accordance with the following embodiments.

Embodiment 17

Tunnel train station with an enclosure in which at least one public waiting area for persons to wait is arranged and at least one vehicle tunnel for the traffic of vehicles, wherein the vehicle tunnel and the public waiting area are connected by means of at least one transportation route, characterized in that the tunnel train station comprises an ambient air purification arrangement for purifying an ambient air with at least one filter unit for separation of solid, liquid or gaseous ambient air pollutants, in particular particulate matter, from the ambient air.

Embodiment 18

Tunnel train station according to embodiment 17, characterized in that the tunnel train station comprises a transition region between the public waiting area and the vehicle tunnel, wherein the filter unit is arranged in the transition region.

The transition region refers in this context to the region in which the vehicle tunnel (and the associated transportation route) opens into the enclosure and the transportation route is arranged adjacent to the public waiting area. Placement of the filter unit at this location of the tunnel train station is advantageous for at least two reasons.

On the one hand, this is the location at which the ambient air contamination is primarily generated. The vehicle that approaches the public waiting area through the vehicle tunnel, will initiate a braking action either already in the vehicle tunnel or at the latest upon moving out of the vehicle tunnel into the enclosure. During this braking action, inter alia particulate matter as ambient air pollutants is generated as described above, e.g. by wear. The filter unit is thus optimally placed at the source of the ambient air pollutants. The efficiency of purification of the ambient air by means of the ambient air purification arrangement can be optimized.

On the other hand, at this location also the use of a passive ambient air purification arrangement or filter unit is advantageous. The reason for this are the flow conditions of the ambient air in the transition region. A vehicle which is moving from the vehicle tunnel into the tunnel train station "pushes" on the one hand an "ambient air cushion" forward in front of it (so-called piston effect). On the other hand, upon traveling through the vehicle tunnel there is also a pressure difference between a vehicle front (excess pressure) and a vehicle end (vacuum) whereby a flow of ambient air between these regions can be produced. In particular in rail vehicles (e.g. subways) that are not aerodynamically designed, a suction or turbulence generation of the ambient air particularly in the transition region can be started. This can be utilized advantageously by passive ambient air purification arrangements or filter units. However, the alternative or additional use of an active ambient air purification arrangement or filter unit can be provided also for improvement of the separation performance.

A tunnel train station can comprise a plurality of vehicle tunnels that serve for entering and leaving of vehicles. It is then advantageous to arrange one or a plurality of filter units at the transition regions of these vehicle tunnels, respectively.

BRIEF DESCRIPTION OF THE DRAWINGS

Further advantages result from the following drawing description. In the drawing, an embodiment of the invention is illustrated. The drawing, description, and claims contain numerous features in combination. A person of skill in the art will consider the features expediently also individually and combine them to expedient further combinations.

DESCRIPTION OF PREFERRED EMBODIMENTS

Figure 1:
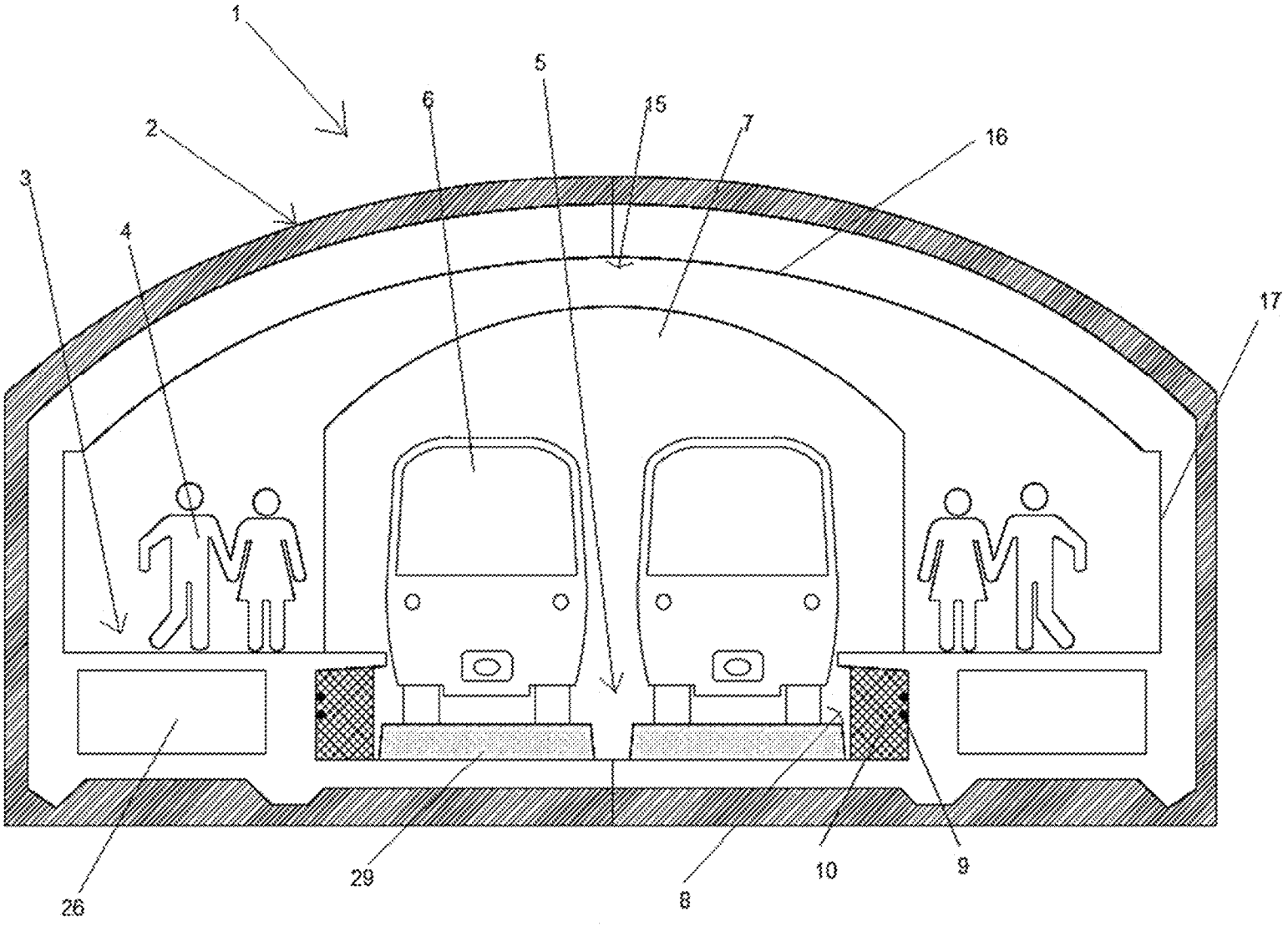
FIG. 1 shows a schematic section view of tunnel train station according to a first embodiment.

The Figures shows only examples and are not to be understood as limiting. In the Figures, same or same-type components are identified with same reference characters.

They show a train station 1 according to the invention with a public waiting area 3. In this public waiting area 3 persons 4 can wait. The public waiting area 3 is arranged spatially adjacent to the transportation route 5. Vehicle 6 can travel on this transportation route 5. The vehicles 6 move in and out of the train station 1.

The illustrated train station 1 can be a train station 1 for rail vehicles (rapid transit trains, subways or tramways) or motor vehicles (buses, long-distance buses etc.). The train station can be an above-ground train station or an underground train station (so-called tunnel train station). The public waiting area 3 can be embodied, for example, from concrete. In this context, as shown, it can enclose a free space 8 together with the transportation route 5. In this free space 8, for example, an electrical cable 9 can be guided that can serve for electrification of the transportation route 5. The free space 8 in the illustrated embodiment is designed as a U-shaped profile and is in particular delimited in upward direction by an overhang of the station platform of the public waiting area 3.

The vehicles 6 which are traveling in the train station 1 constitute a source of ambient air pollutants. This is the case, on the one hand, due to the emissions of the drive means (e.g. an internal combustion engine) but also by wear debris of braking during a braking action of the vehicle 6. In particular, loading of the ambient air with so-called particulate matter can be found to be a health hazard to the persons 4 which are present in the public waiting area 3. It is necessary to reduce the load with ambient air pollutants of the ambient air in the train station 1 or to remove them again from the ambient air.

For this purpose, an ambient air purification arrangement is provided in the train station 1. The ambient air purification arrangement comprises at least one filter unit 10.

The tunnel train station 1 illustrated in FIG. 1 is closed by an enclosure 2 relative to its environment. For this reason, for safety and health considerations, a sufficient circulation of ambient air contained within the enclosure 2 must be carried out. In this context, it must be considered in particular that the vehicles 6 which are traveling in the tunnel train station 1 constitute a source of ambient air pollutants.

This is the case, on the one hand, due to the emissions of the drive means (e.g. an internal combustion engine) but also by wear debris of braking during a braking action of the vehicle 6. In particular, loading of the ambient air with so-called particulate matter can be found to be a health hazard to the persons 4 which are present in the public waiting area 3. It is necessary to reduce the load with ambient air pollutants of the ambient air in the tunnel train station 1 or to remove them again from the ambient air.

For this purpose, an ambient air purification arrangement is arranged in the tunnel train station 1. The ambient air purification arrangement comprises at least one filter unit 10 for separating solid, liquid or gaseous ambient air pollutants, in particular particulate matter, from the ambient air. In the illustrated embodiment of FIG. 1, the filter unit 10 is arranged in the free space 8. This arrangement is particularly advantageous because the free space 8 is already present in most tunnel train stations 1 in the form of the illustrated U-shaped molded concrete part, i.e., as an overhang of the station platform. Moreover, the free space 8 which is typically extending across the entire length of the public waiting area 3 provides for a substantially unhindered outflow region for the filter unit 10. The latter can be operated e.g. as a passive system. The vehicle 6 which are moving from the vehicle tunnel 7 into the enclosure 2 produce thereby by means of the so-called piston effect a satisfactory suction in the ambient air. The filter unit 10 will thus be designed to be flowed through in a length direction of the public waiting area 3. Other flow directions are however also conceivable. Also, the filter unit 10 can be operated (additionally) as an active system in order to further increase the separation performance. The filter unit 10 is located thus also at the source of the ambient air pollutants, i.e., in neighborhood to the vehicles 6. The efficiency of the purification of the ambient air is optimized.

A further advantage of the arrangement of the filter unit 10 in the free space 8 is that it is protected there from an unauthorized access by persons 4 (and thus also from vandalism). Already existing installation space is utilized in the tunnel train station 1. The clearance profile provided for the transportation route 5 is not infringed.

Figure 2:
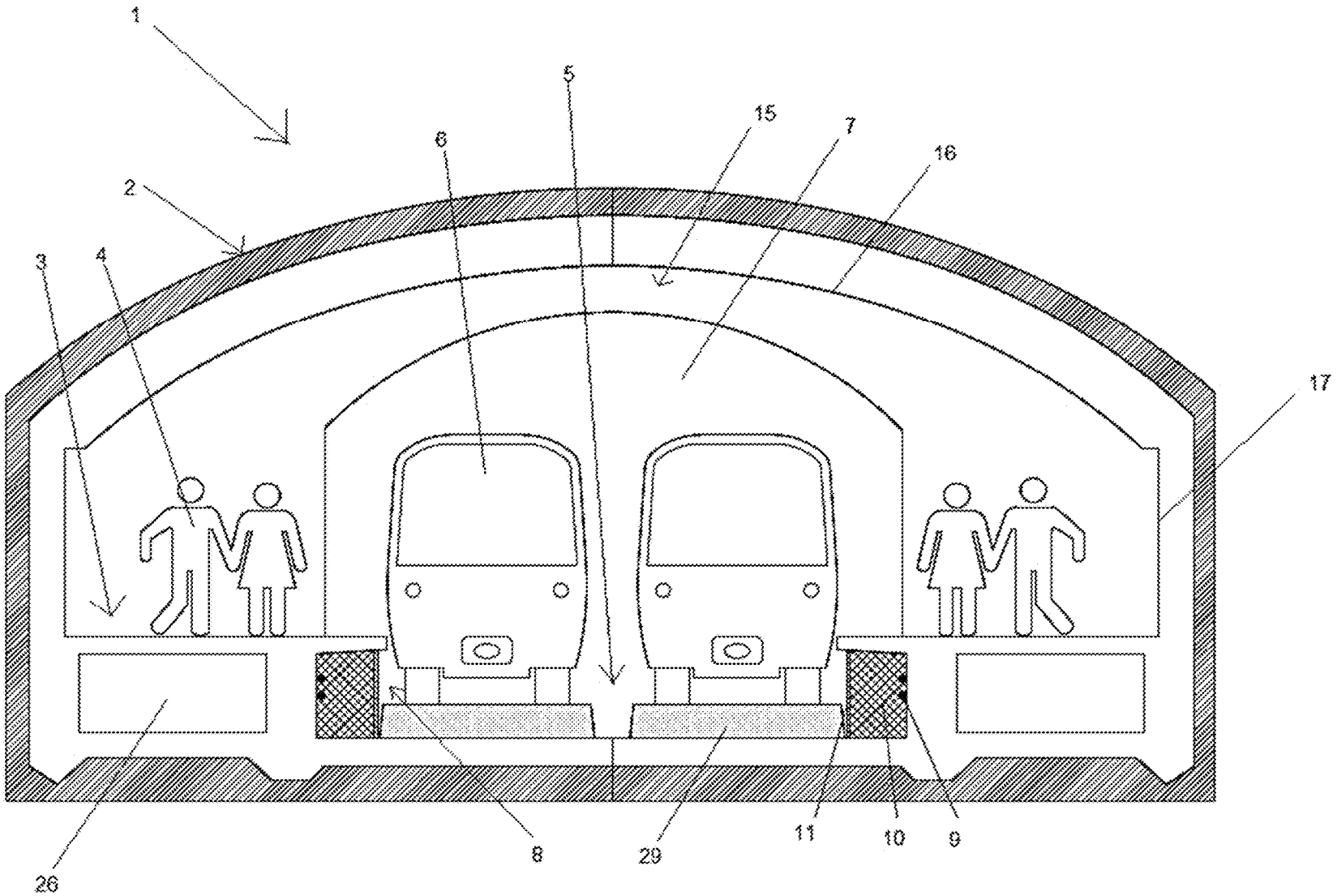
FIG. 2 shows a schematic section view of the tunnel train station according to a second embodiment.

FIG. 2 shows a further embodiment of the tunnel train station 1. It corresponds substantially to the embodiment of FIG. 1. However, a protection device 11 is provided here additionally. It separates the free space 8 from the transportation route 5. Thus, the filter unit 10 is "encased" in the free space 8. The protection device 11 can be, for example, embodied as a protective grid. This protective grid serves to protect the filter unit 10 from environmental effects: on the one hand, it protects against vandalism by persons 4; on the other hand, it can however protect against damage of the filter unit 10 by animals that are present in the transportation route 5 (e.g. rodents). Also, damage by waste or the like swirled up by the vehicle 6 entering or leaving is avoided. The mesh width of the protective grid is designed such that it causes only a negligibly small pressure loss in the environment of the filter unit 10. The filter unit 10 can be operated still as a passive system (additionally as an active system, as needed).

Figure 3:
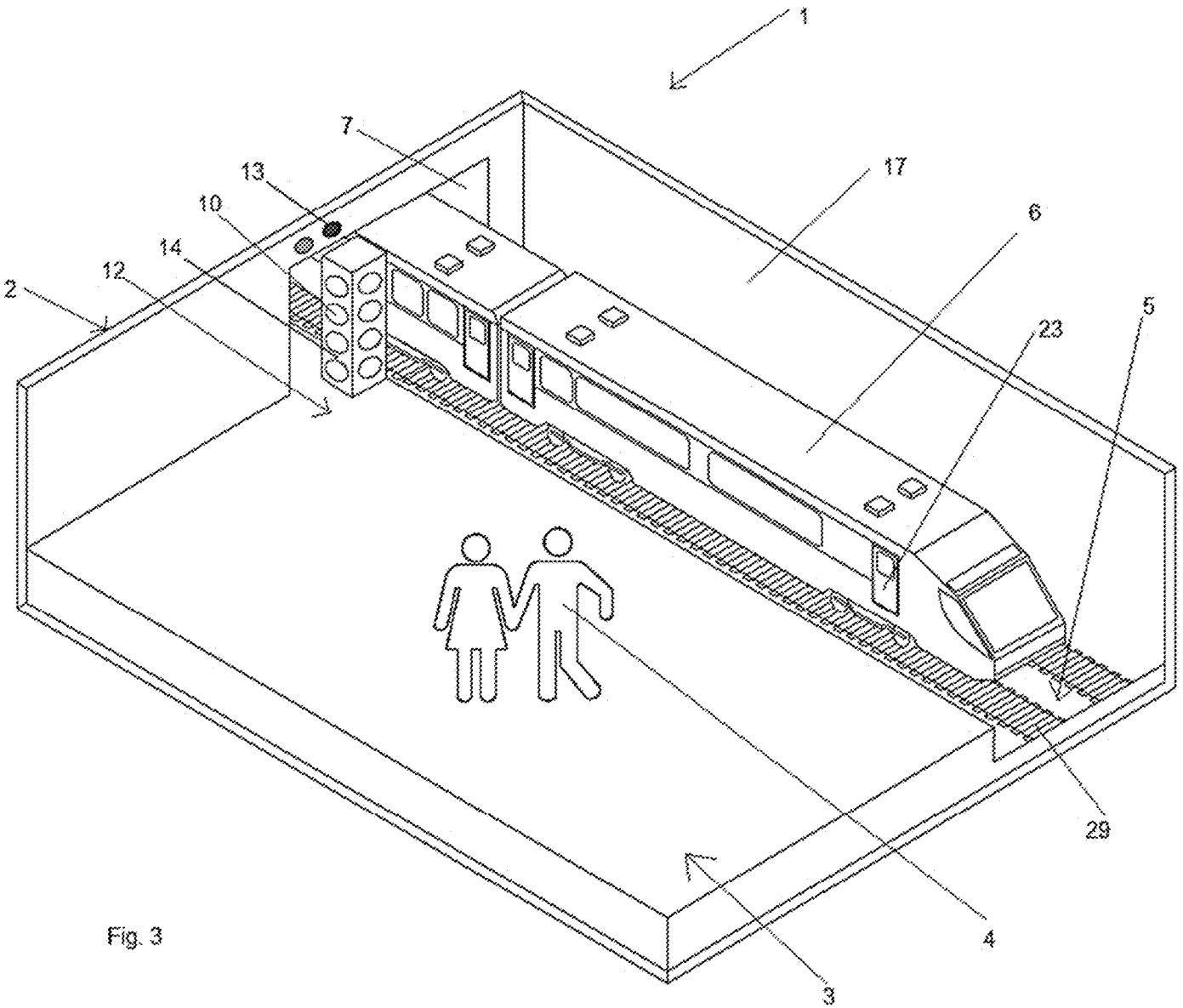
FIG. 3 shows a schematic view from above of a detail of the tunnel train station according to a third embodiment.

FIG. 3 shows a schematic view from above of a tunnel train station 1. Here, in particular a transition region 12 between the vehicle tunnel 7 and the public waiting area 3 can be seen. In this transition region 12, a light signal device 13 for entering and leaving vehicles 6 is arranged above the vehicle tunnel 7. Also, in the transition region 12 a column-shaped structural element 14 is provided. This column-shaped structural element 14 comprises the filter unit 10. The arrangement of the column-shaped component 14 in the transition region is advantageous again because, on the one hand, the filter unit 10 is located thus near the source of ambient air pollutants. On the other hand, it can be operated as a passive system because a sufficient suction by the piston effect of an entering and leaving vehicle 6 is provided at this location.

Moreover, the embodiment of the ambient air purification arrangement has in addition the advantage that it prevents persons 4 from accessing the vehicle tunnel 7. They cannot without problem enter the vehicle tunnel 7. In the column-shaped structural element 14, the filter unit 10 can also be adequately protected by a housing against vandalism and other unauthorized access.

Figure 4:
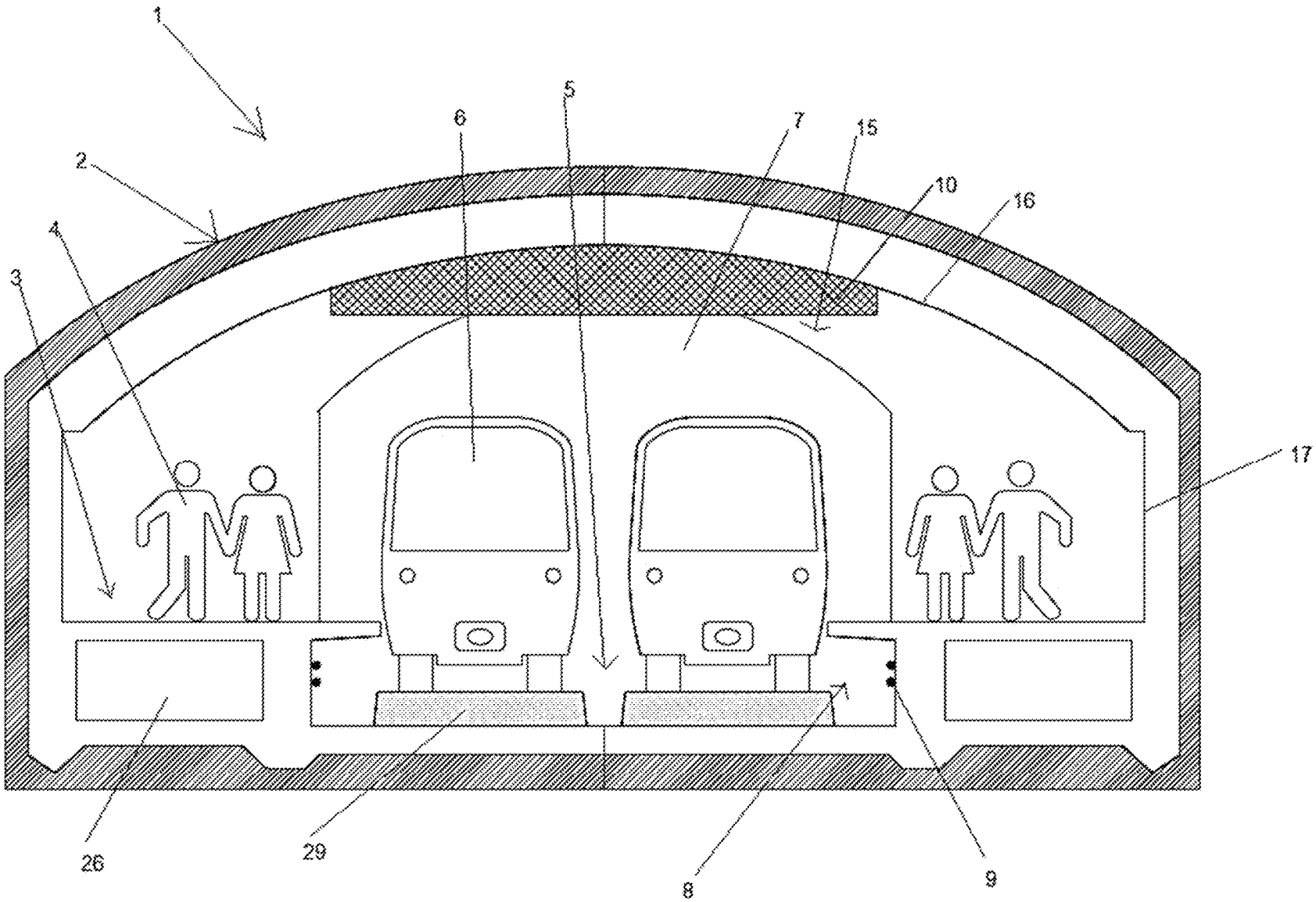
FIG. 4 shows a schematic section view of the tunnel train station according to a fourth embodiment.

FIG. 4 shows a section illustration of an embodiment of the tunnel train station 1. In this embodiment, the filter unit 10 is arranged in a ceiling region 15 of the enclosure 2. The filter unit 10 is here attached to a ceiling 16 of the enclosure 2. It is arranged above the transportation route 5. Here, the ambient air contamination is typically strongest due to the vehicles 6 which are traveling in this region. Here also, the filter unit 10 can be operated as a passive and/or active system. In case that the transportation route 5 has overhead contact lines (not illustrated), the filter unit 10 in the illustrated arrangement is also arranged such that it leaves open the clearance profile of the transportation route 5, i.e., does not infringe it. In this arrangement suspended from the ceiling area 15 or the ceiling 16 of the enclosure 2, the filter unit 10 is also protected from vandalism by persons 4. They cannot reach the filter unit 10 without additional auxiliary means.

Figure 5:
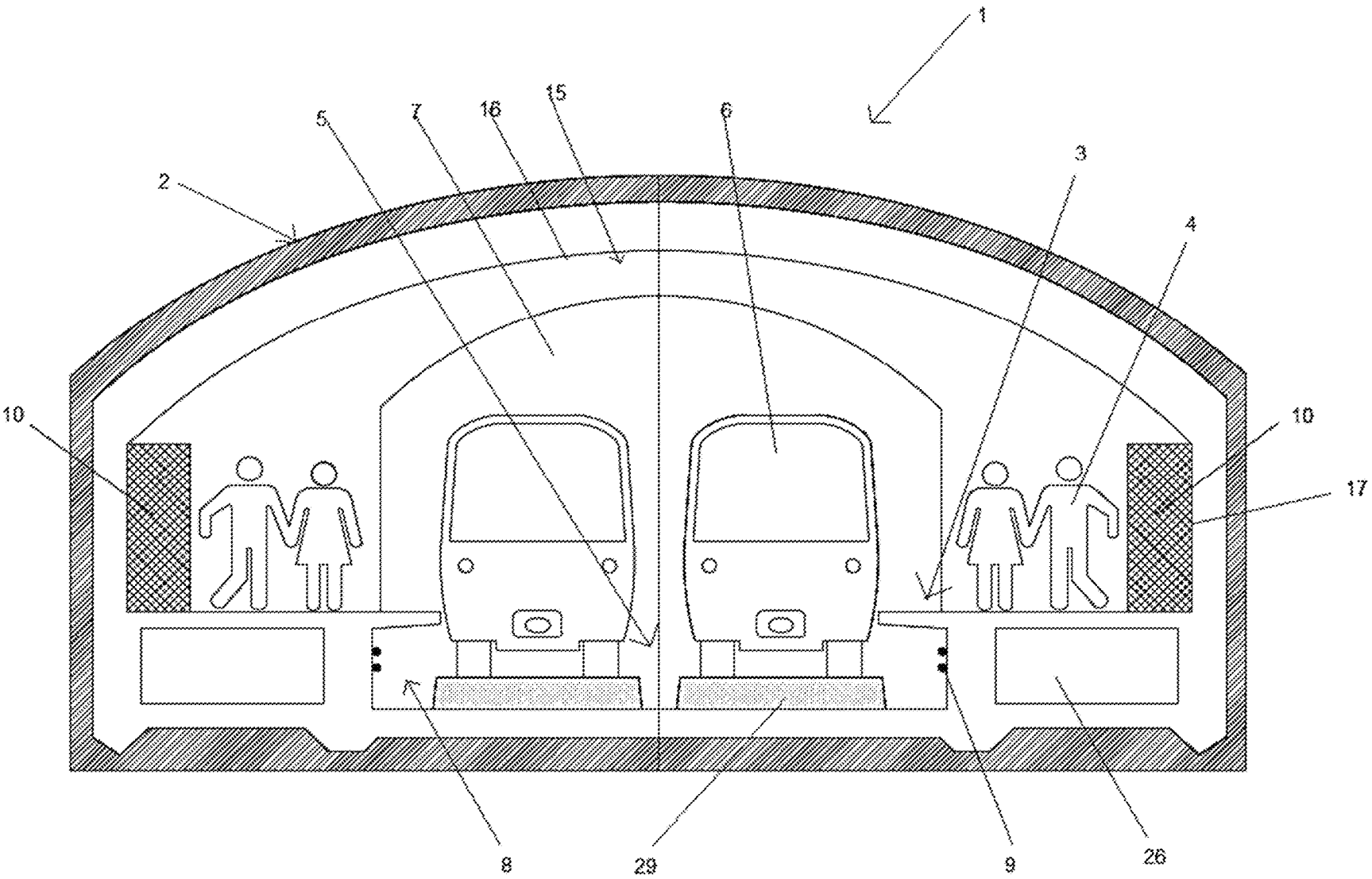
FIG. 5 shows a schematic section view of the tunnel train station according to the invention according to a fifth embodiment.

In FIG. 5, a further embodiment of the present tunnel train station 1 is illustrated. Here, the filter unit 10 is embodied as a freestanding structural element in the public waiting area 3 at a side wall 17. Advantage of this arrangement is that the public waiting area 3 substantially remains free for persons 4 or other objects. Here, the filter unit 10 can also be enclosed in a housing in order to protect it from unauthorized access and vandalism. At the same time, it is easily accessible for a technician, e.g. for servicing purposes. In this position, the filter unit 10 is preferably embodied as an active system that comprises corresponding ambient air inlets (not illustrated) and ambient air outlets (not illustrated) in order to transport the ambient air through the filter unit 10 for purposes of purification. The filter unit 10 is embodied across a height of the side wall 17.

Figure 6:
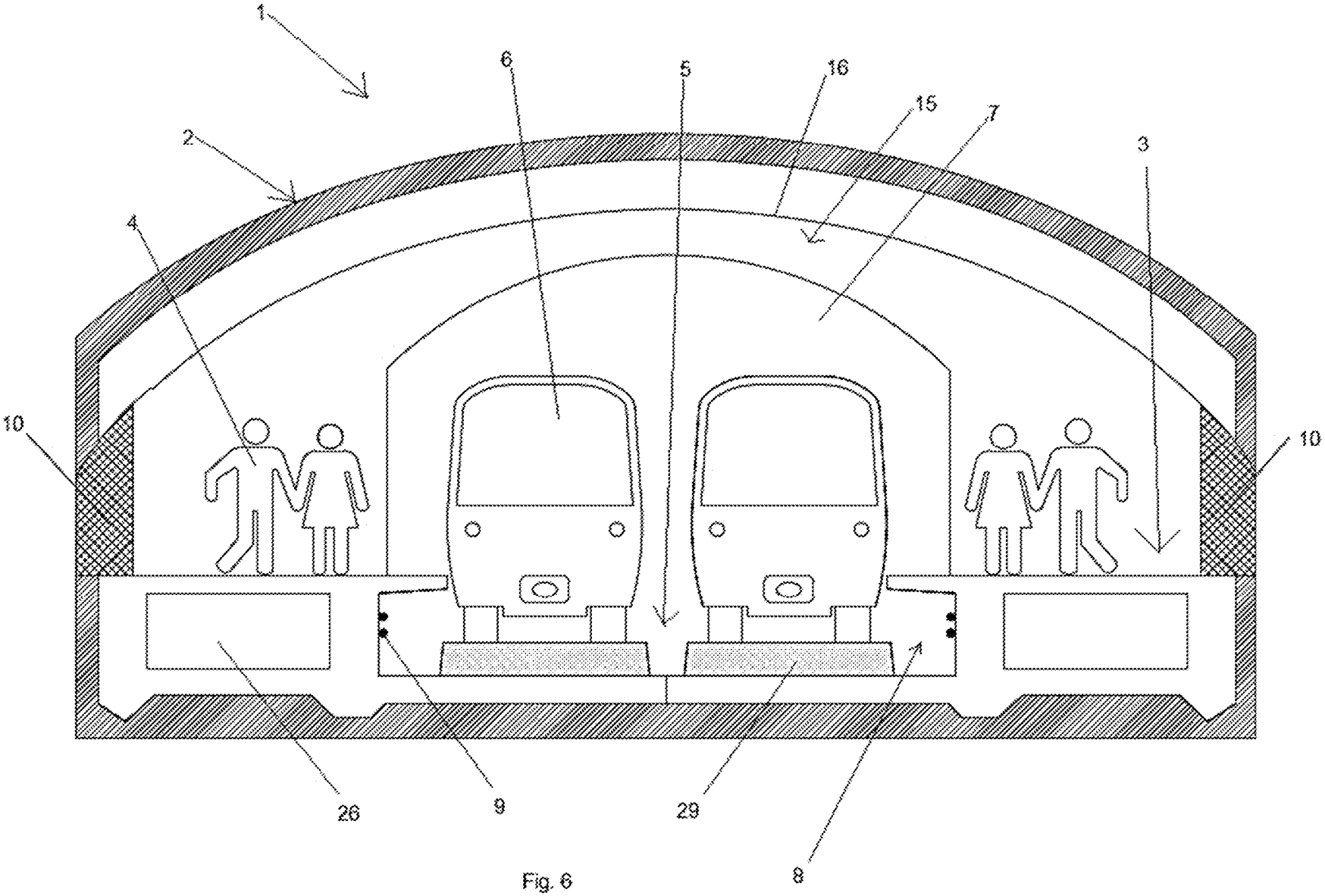
FIG. 6 shows a schematic section view of the tunnel train station according to the invention according to a sixth embodiment.

FIG. 6 shows an embodiment similar to that of FIG. 5. Here, the filter unit 10 is however not arranged freestanding within the public waiting area 3 but is at least partially recessed into the side wall 17. In this way, on the one hand, it is possible to utilize, as needed, installation space that is available in the side wall 17 but otherwise unused. On the other hand, the filter unit 10 is still further retracted with regard to the public waiting area 3. Also, an access to the filter unit 10 through a servicing corridor (not illustrated) or the like in the side wall 17 for servicing purposes is conceivable here. The filter unit 10 is operated preferably as an active system.

Figure 7:
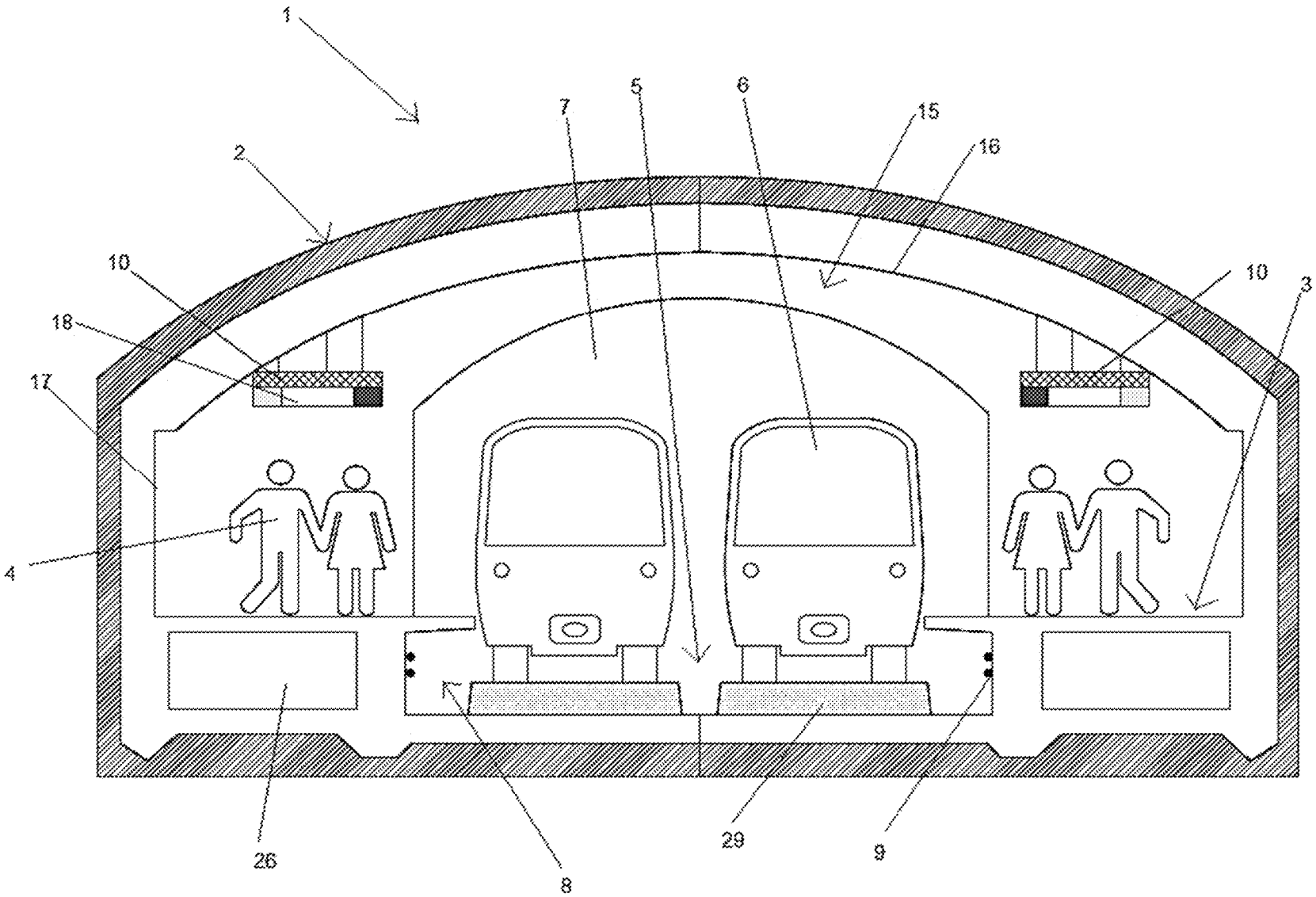
FIG. 7 shows a schematic section view of the tunnel train station according to a seventh embodiment.

In FIG. 7, a tunnel train station 1 with a multimedia device 18 is shown. This multimedia device 18 is illustrated here suspended from the ceiling area 15 of the enclosure 2. The multimedia device 18 in the illustrated example can be a display panel that displays information regarding the train operation in the tunnel train station 1 or other information (e.g. safety information). It can be seen that the filter unit 10 is again positioned outside of the reach of persons 4. Vandalism can be prevented. Also, the filter unit 10 can be retrofitted easily on a multimedia device 18 that is present in the tunnel train station 1. The filter unit 10 will be preferably at least additionally an active system.

Figure 8:
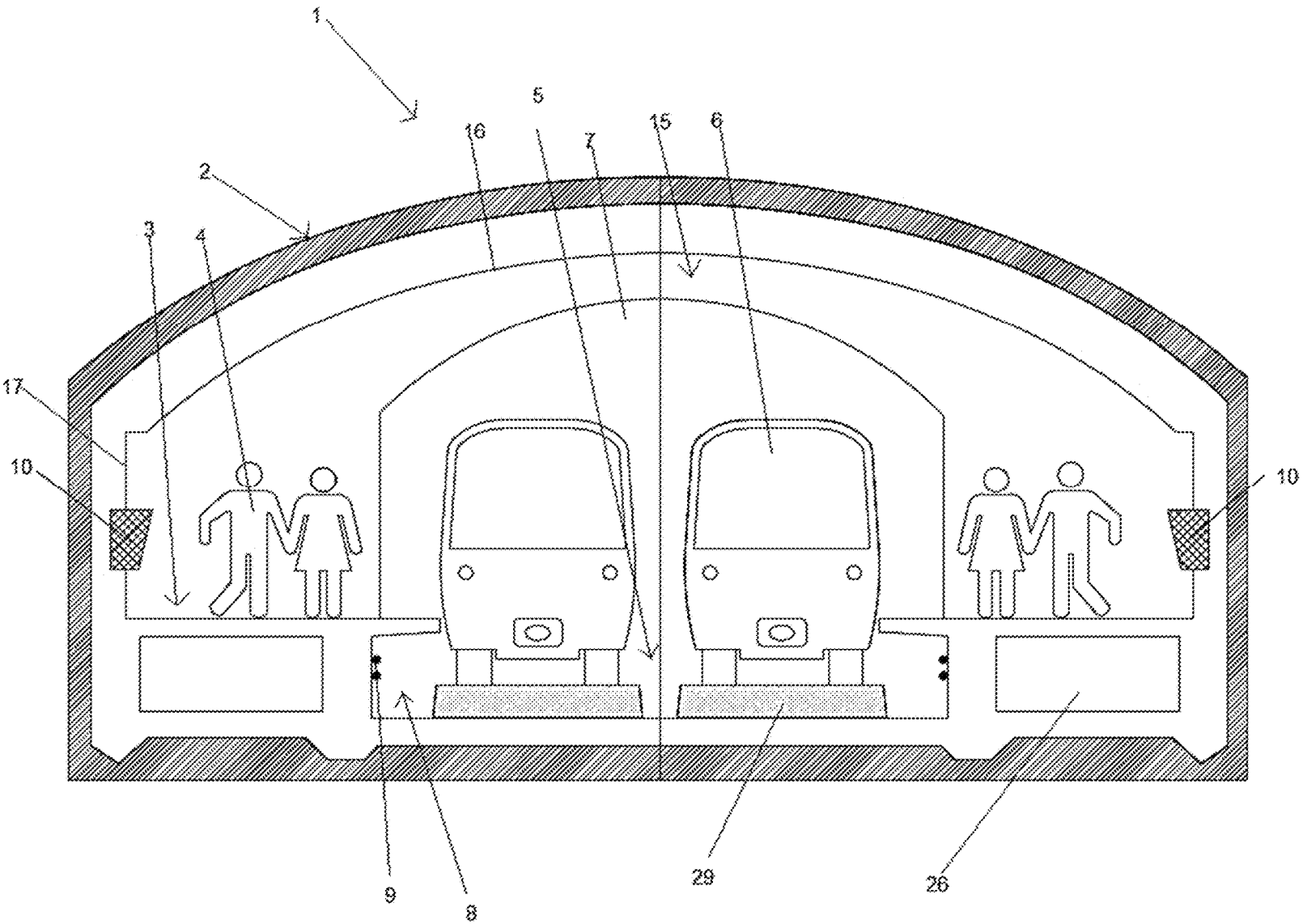
FIG. 8 shows a schematic section view of the tunnel train station according to an eighth embodiment.

FIG. 8 again employs the attachment of the filter unit 10 according to the embodiment of FIGS. 5 and 6. In this embodiment, the filter unit 10 however is embodied in a compact configuration. In the illustrated embodiment, it comprises substantially the size of a waste disposal container. It is mounted approximately at half the height of the side wall 17 of the enclosure 2 partially in the side wall 17. This height enables a technician with a comfortable access e.g. for servicing purposes. Again, the filter unit 10, as in all embodiments in which it is arranged in the public waiting area 3, will comprise a housing for its protection with corresponding ambient air inlets and ambient air outlets. The filter unit 10 will be preferably (at least additionally) an active system.

Figure 9:
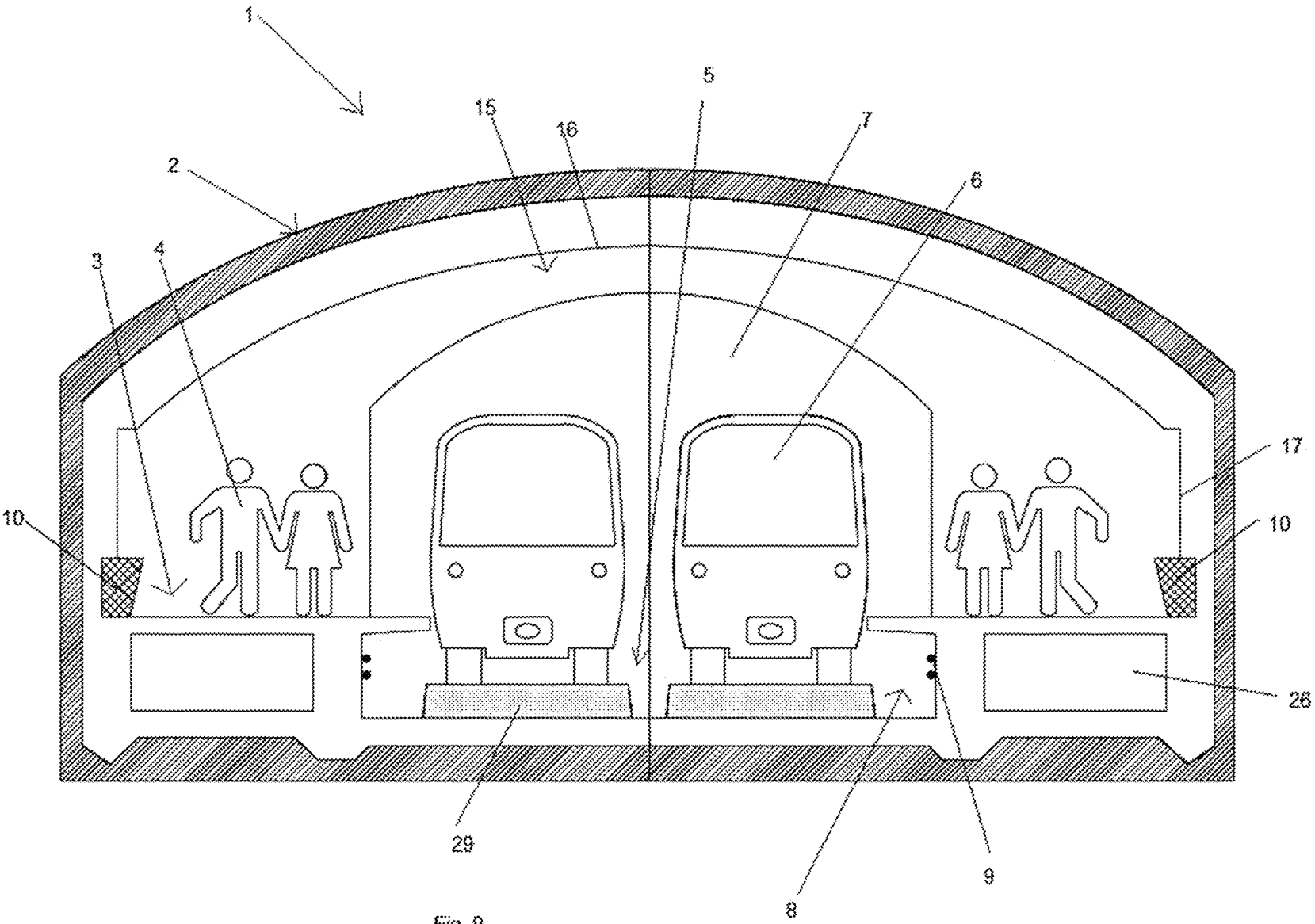
FIG. 9 shows a schematic section view of the tunnel train station according to a ninth embodiment.

A similar embodiment is also illustrated in FIG. 9. Here, the filter element unit 10 is however arranged on a floor of the public waiting area 3 in the side wall 17. As a whole, the compact filter units 10 of the FIGS. 8 and 9 efficiently utilize the installation space, which is in any case sparsely provided in a tunnel train station 1, without interrupting the operation of the tunnel train station 1 thereby.

Figure 10:
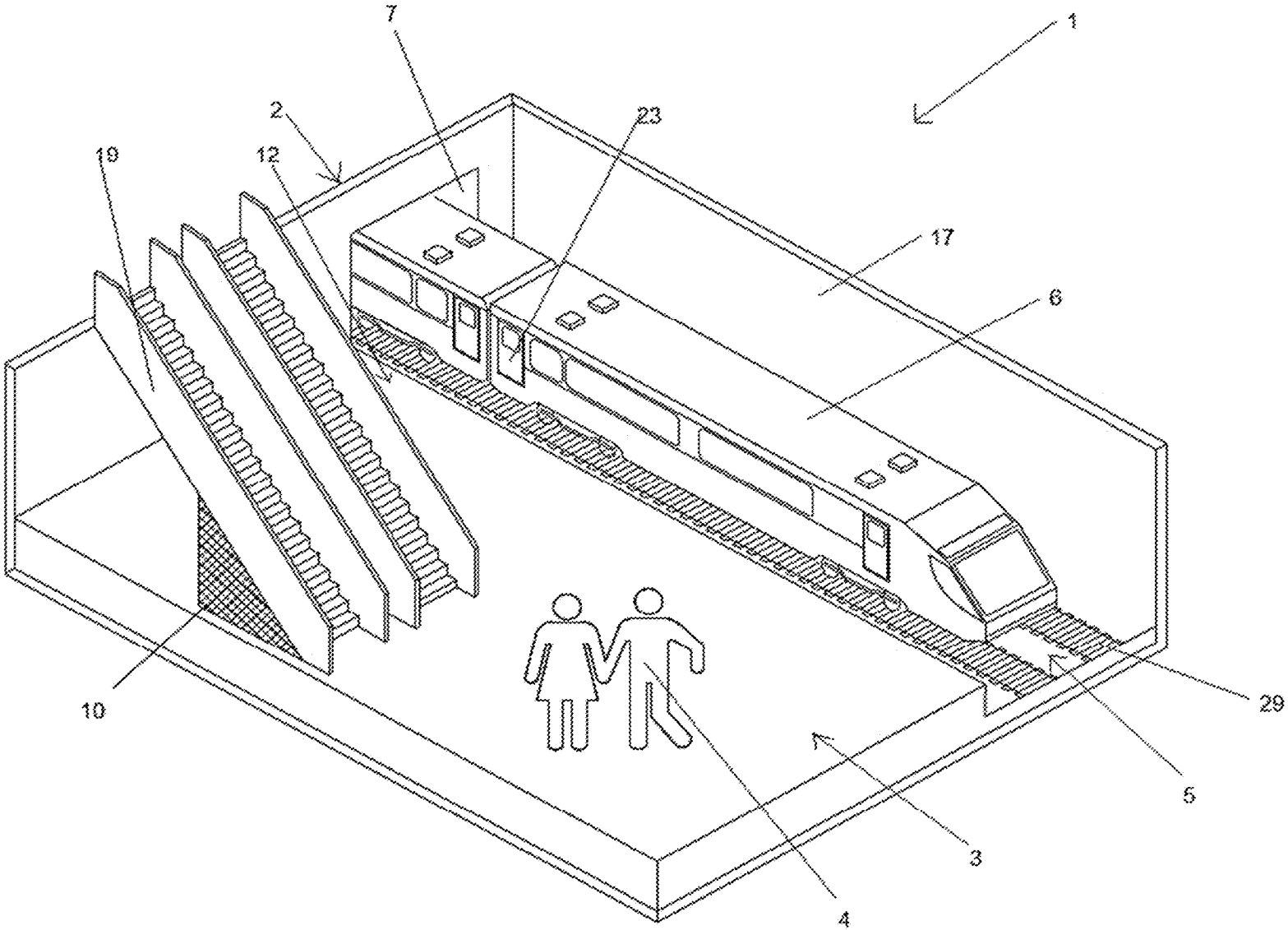
FIG. 10 shows a schematic view from above of a detail of the tunnel train station according to a tenth embodiment.

In FIG. 10, a tunnel train station 1 with a stairway 19 is illustrated. The stairway 19 is configured as a self-supporting stairway. The stairway 19 can serve to enable persons 4 to exit the public waiting area 3. This can serve purposes of leaving the tunnel train station 1 or of changing to a different public waiting area 3. Here, below the stairway 19, a free space is present which is provided due to its construction as a self-supporting stairway. In this space, the filter unit 10 can be arranged; it utilizes already existing installation space expediently. The filter unit 10 is preferably (at least additionally) an active system, i.e., a system which comprises, in addition to at least one filter element, at least one blower for producing an air flow through the filter element.

Figure 11:
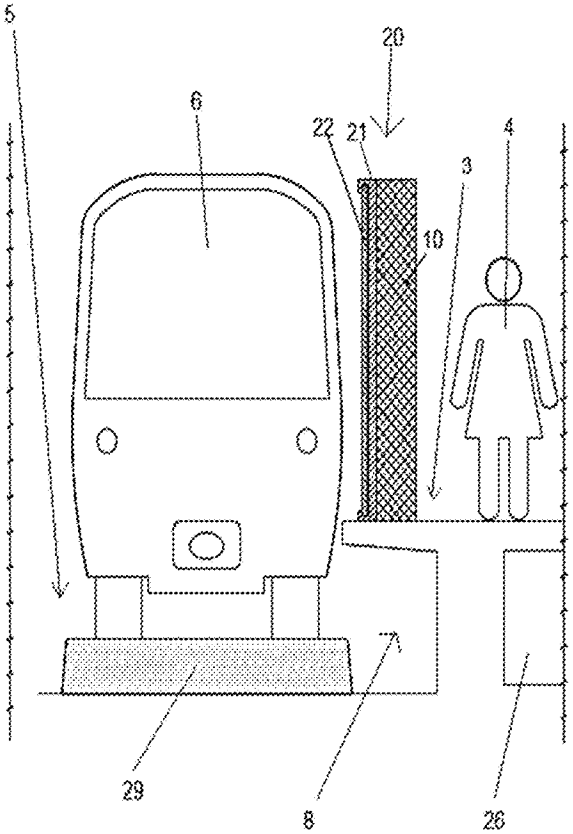
FIG. 11 shows a schematic view of a detail of the tunnel train station according to an eleventh embodiment.
Figure 11:
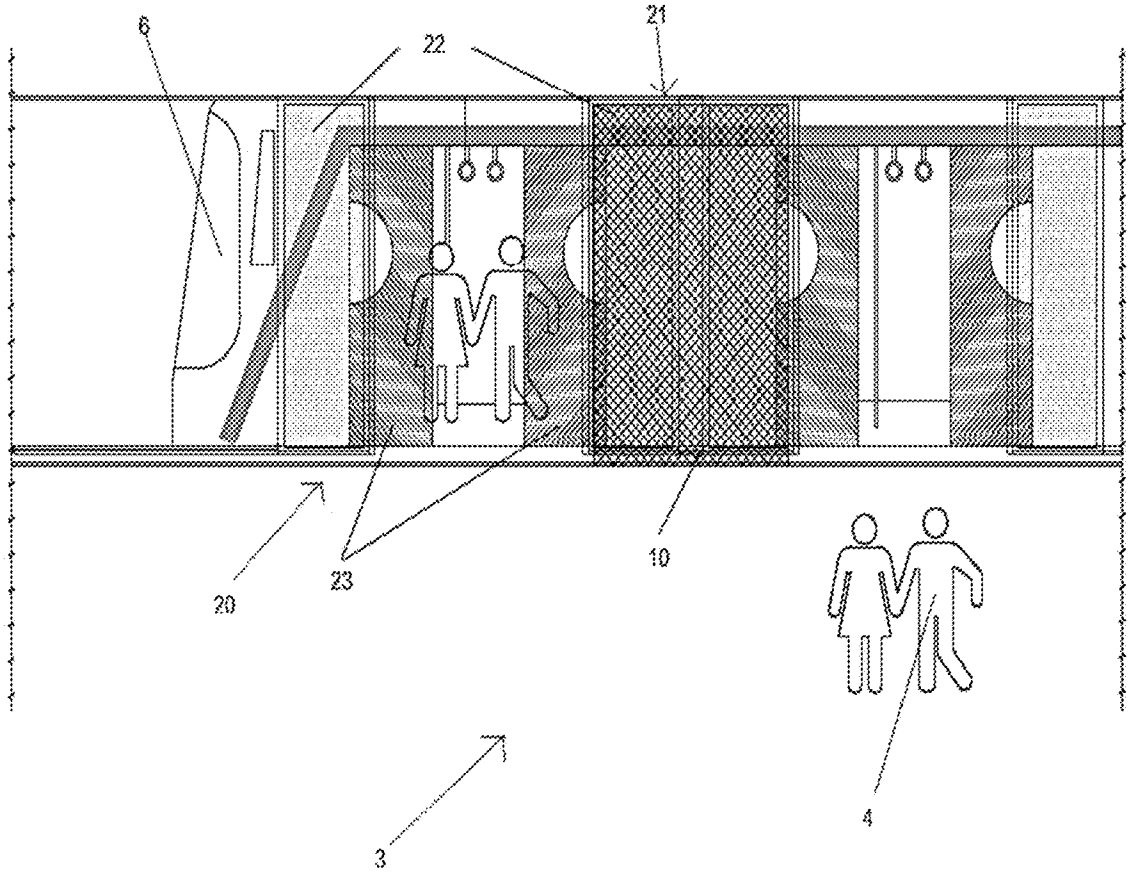

FIG. 11 shows a train station 1 or tunnel train station 1 with a partition device 20 that is designed as an access control device and comprises a plurality of partition elements 21 and partition doors 22 or access control doors 22 arranged therebetween. Such an embodiment is suitable likewise for above-ground train stations as well as underground tunnel train stations. The partition elements 21 are connected rigidly and stationarily with the public waiting area 3 while the partition doors 22 or access control doors 22 can be selectively openable and closable. In the partition elements 21, the technology (mechanism, drive motors, control technology) required for movement of the access control doors 22 is arranged.

The partition device 20 serves to keep persons 4 away from the transportation route 5. Thus, they cannot be hit by an incoming vehicle 6 or access unauthorized the transportation route 5. At the point in time when the vehicle 6 enters the enclosure 2, the partition doors 22 are closed. The vehicle 6 then begins a braking process until it comes to a stop at a predetermined holding position along the public waiting area 3. Now a vehicle door 23 opens which is arranged in alignment with the partition door 22. The partition door 22 also opens. Persons 4 can board or deboard the vehicle 6, i.e., an exchange of persons takes place.

In general, in particular the partition elements 21 comprise unused space which is not occupied by the technology that is required for moving the access control doors 22. In it, e.g. the filter unit 10 can be arranged. It can be received therein in a flat arrangement or can be attached to a surface of the partition element 21 or can be integrated into a volume which is made available by the respective partition element 21. Also, it is possible to provide the filter unit 10 in the partition door 22. The filter unit 10 is preferably (at least additionally) an active system, i.e., a filter unit which comprises at least a blower for producing an air flow. It is advantageously arranged in the vicinity of the source of the ambient air pollutants.

Figure 12:
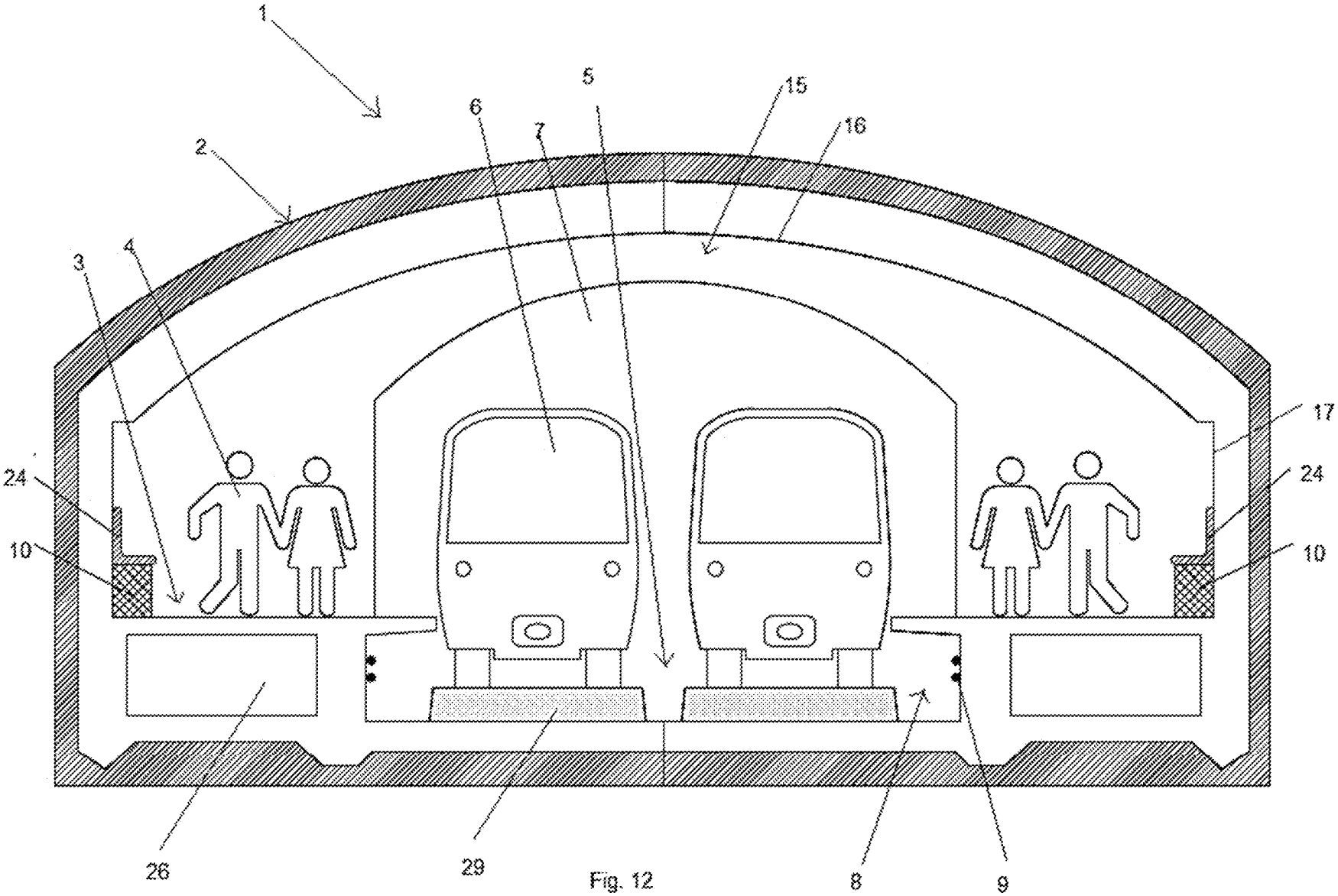
FIG. 12 shows a schematic section view of the tunnel train station according to a twelfth embodiment.

In FIG. 12, a further embodiment of the tunnel train station 1 is shown in turn. It takes advantage of seats 24, here in the form of seating, being arranged in the tunnel train station 1. They can be arranged freestanding in the public waiting area 3, e.g. at the side wall 17 of the enclosure 2. Below such seats 24, there is typically freely available space. The filter unit 10 can be arranged in it. It will be embodied in a compact design and, as already disclosed, received in a housing. The filter unit 10 will be preferably (at least additionally) an active system. The filter unit 10 can be retrofitted easily as a module in a tunnel train station 1.

Figure 13:
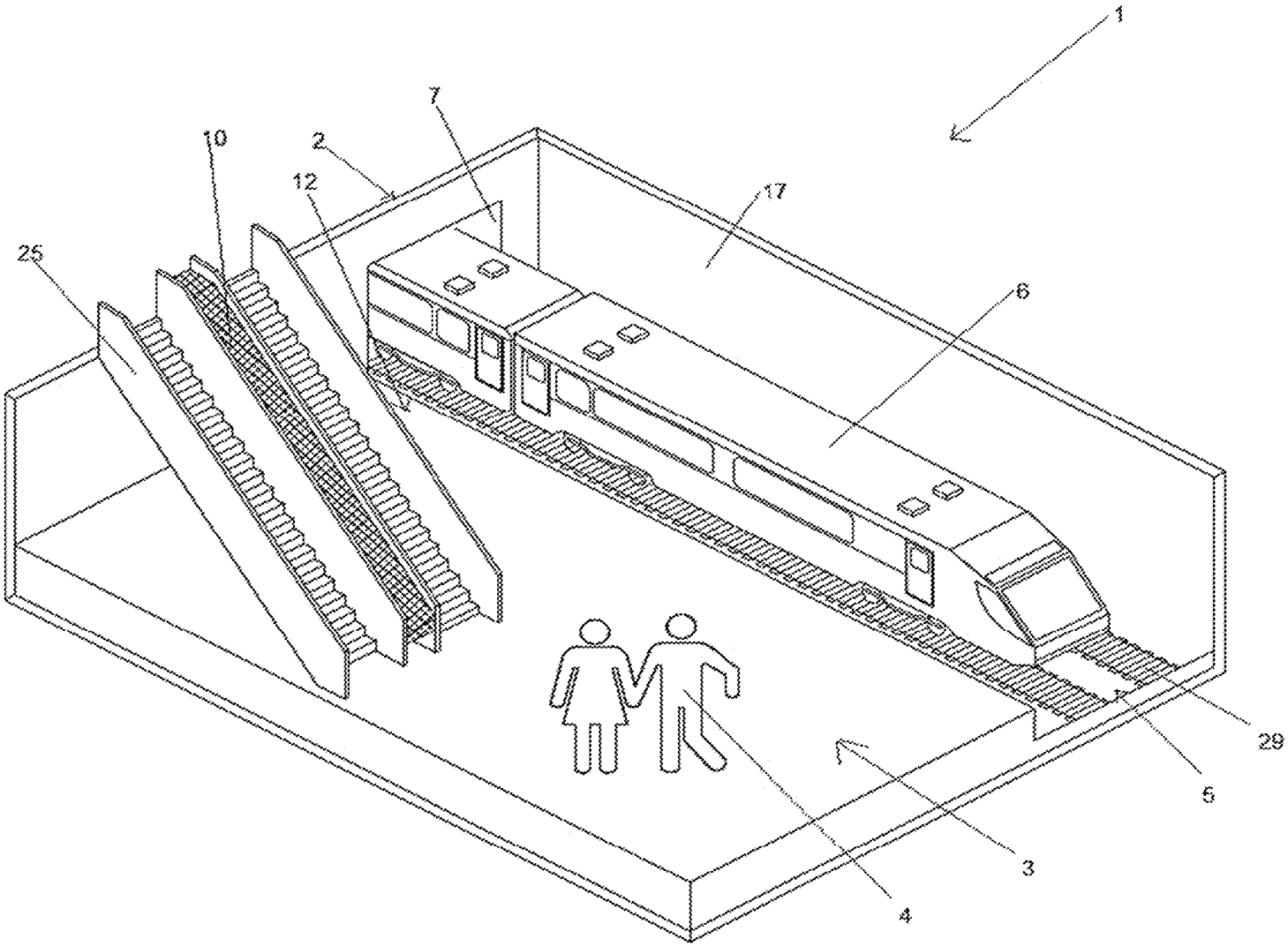
FIG. 13 shows a schematic view from above of a detail of the tunnel train station according to a thirteenth embodiment.

FIG. 13 shows an embodiment similar to FIG. 10. Here, the tunnel train station 1 comprises an escalator 25. In the illustrated embodiment, two escalators 25 (possibly in opposite directions) are arranged adjacent to each other. Between these escalators 25, a separation region is provided in which the filter unit 10 is arranged in an areal arrangement. This space is otherwise unused and is available advantageously for the filter unit 10. The filter unit 10 will preferably be (at least additionally) an active system.

Figure 14:
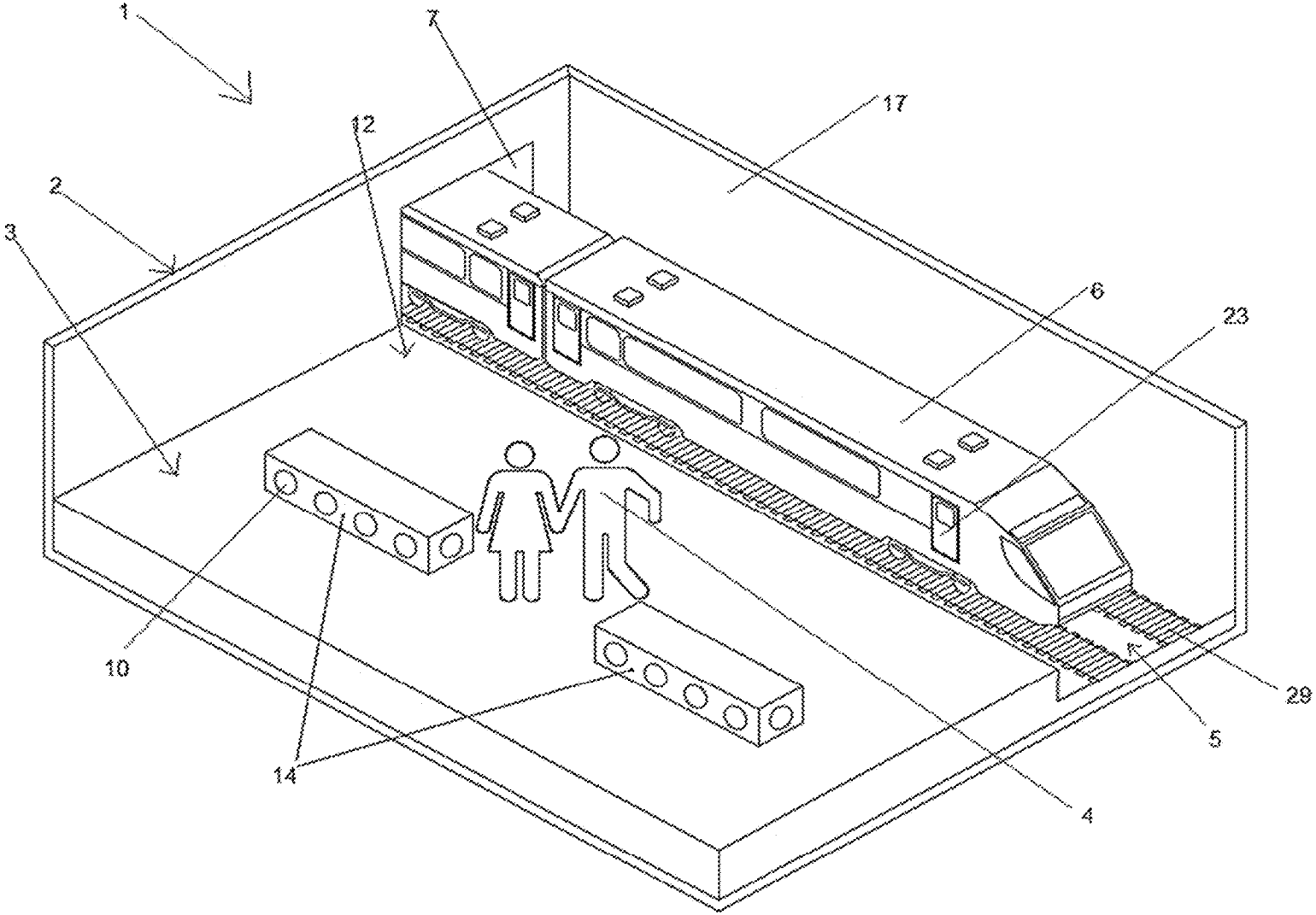
FIG. 14 show a schematic view from above of a detail of the tunnel train station according to fourteenth embodiment.

FIG. 14 shows, as already similarly in FIG. 3, the column-shaped structural element 14. The latter in the illustrated embodiment is however not arranged in the transition region 12 but freestanding in the public waiting area 3. Also, the column-shaped structural element 14, in contrast to FIG. 3 (vertical arrangement), is now arranged horizontally. In this embodiment, the column-shaped structural element 14 can serve also as a seat 24 for persons 4. It is understood that the column-shaped structural element 14 for this purpose comprises a housing with corresponding ambient air inlets and outlets, as described above, in order to protect it from damage. The filter unit 10 will be preferably (at least additionally) an active system.

Figure 15:
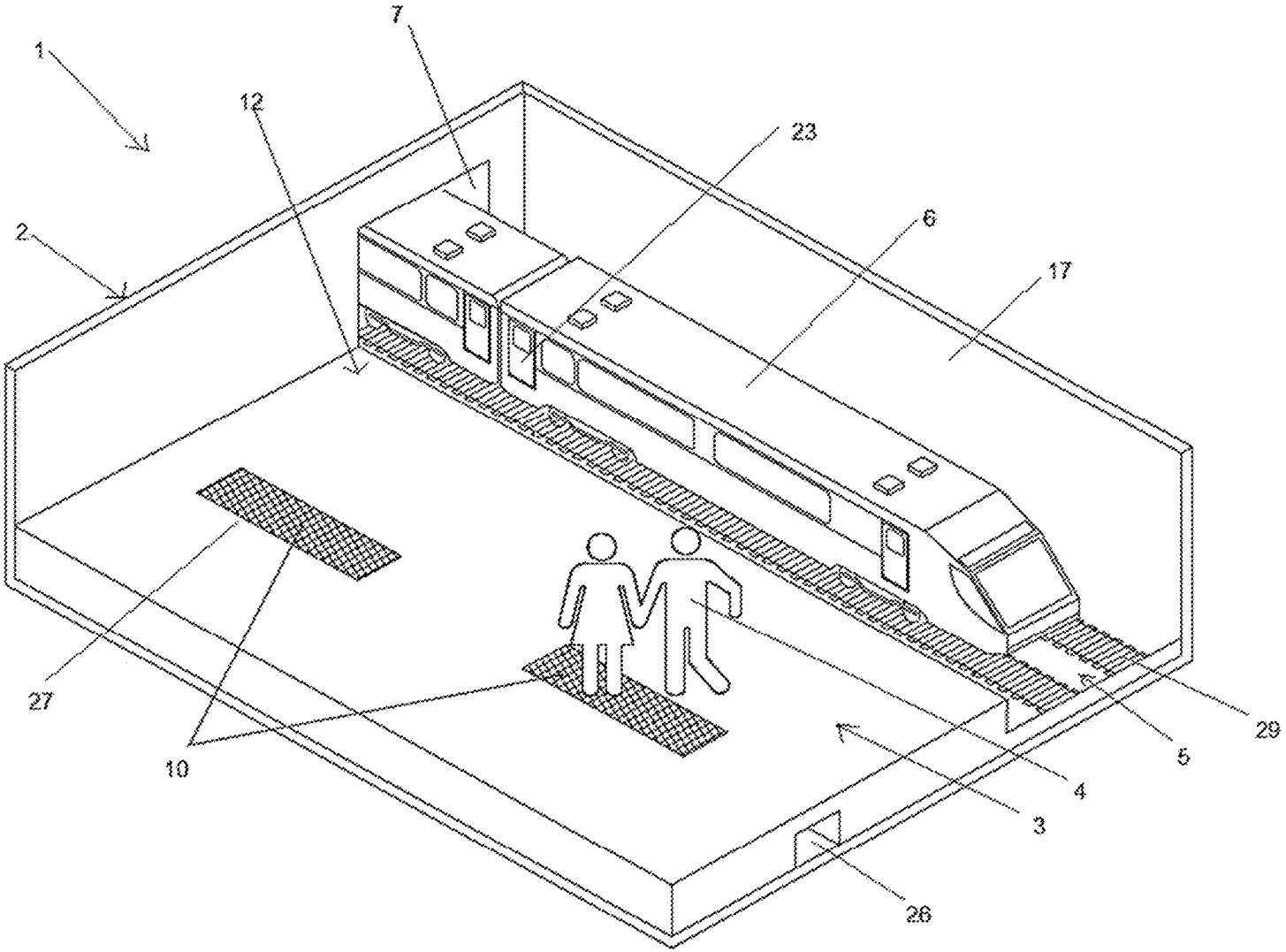
FIG. 15 shows a schematic view from above of a detail of the tunnel train station according to fifteenth embodiment.

In FIG. 15, an embodiment is illustrated that comprises a hollow space 26 in the public waiting area 3. This hollow space 26 can be, for example, a cable channel or channel for venting of an air conditioning device. It comprises here a grid 27 that ends flush with the floor of the public waiting area 3. Below this grid 27, the filter unit 10 is arranged. Here, correspondingly operated as an active system, it can suck in ambient air from the public waiting area 3 for purposes of purification.

Figure 16:
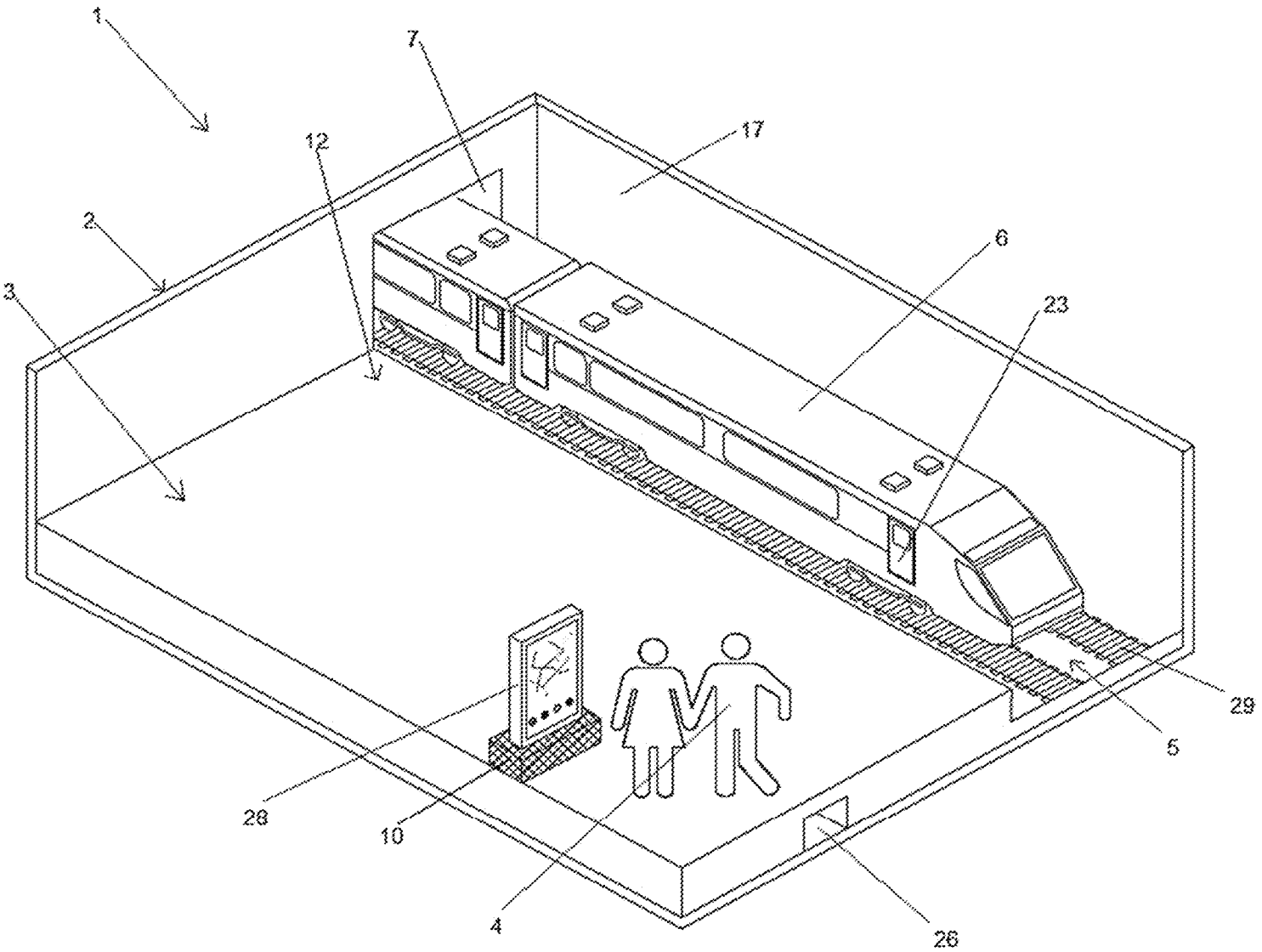
FIG. 16 shows a schematic view from above of a detail of the tunnel train station according to sixteenth embodiment.

FIG. 16 shows again a display panel 28 that can be understood also as the multimedia device 18 of FIG. 7. The display panel 28 can display, for example, advertising information or information in regard to the route map or the departure times of the vehicles 6. The filter unit 10 is arranged in a space-saving way below the display panel 28 which is arranged freestanding in the public waiting area 3.

Figure 17:
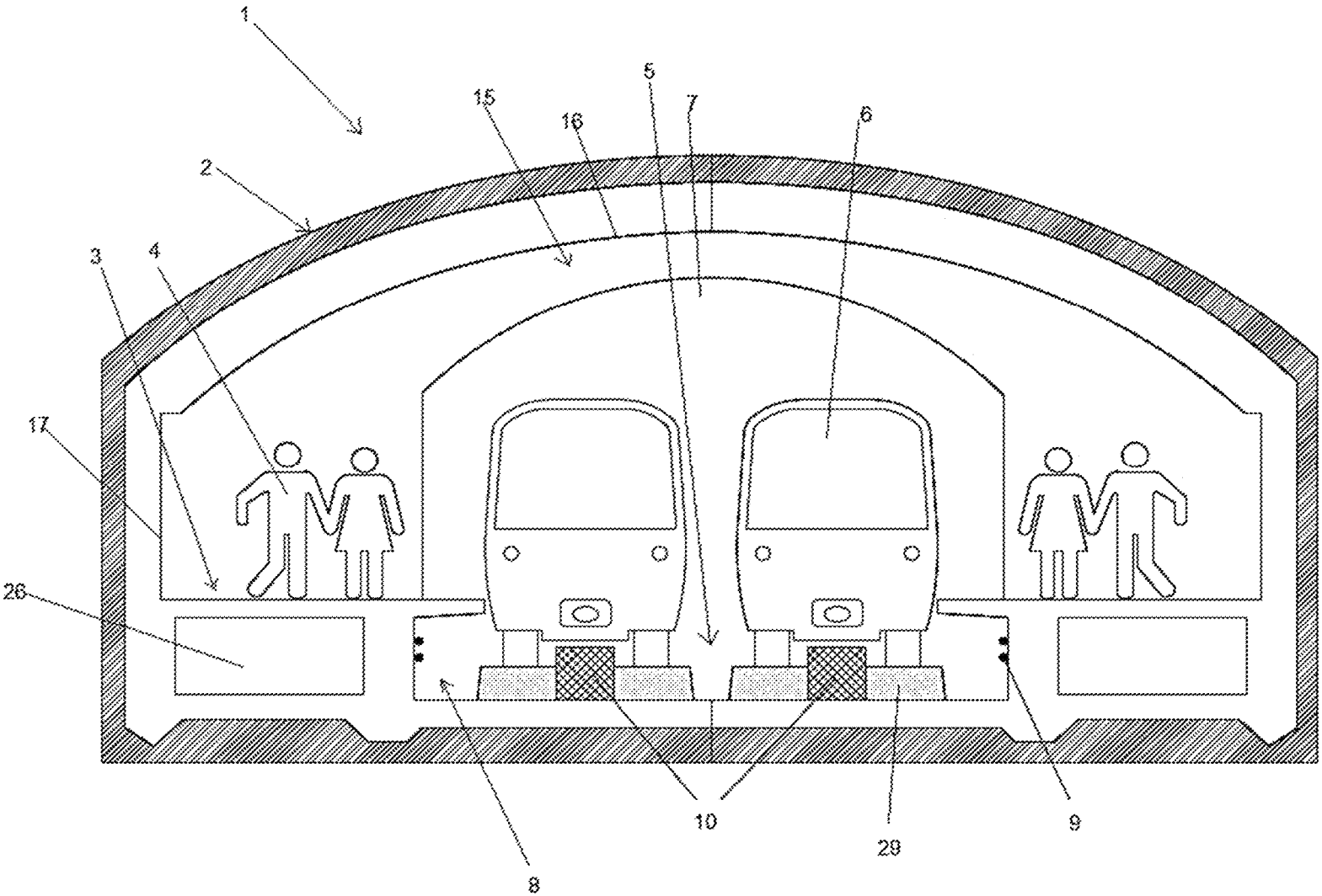
FIG. 17 shows a schematic section view of the tunnel train station according to a seventeenth embodiment.

In FIG. 17, a tunnel train station 1 is finally shown which comprises a track-guiding element 29 in the transportation route 5. In the illustrated embodiment, two respective pairs of track-guiding elements 29 are arranged spatially adjacent to each other. The track-guiding element 29 can be e.g. a rail. Two track-guiding elements 29 of a pair of track-guiding elements 29 are adjacently arranged at a constant distance. This distance defines a track gauge of the pair of track-guiding elements 29. Between the track-guiding elements 29 there is thus a free space provided. This free space can be provided for receiving the filter unit 10. In the illustrated embodiment, the filter unit 10 is arranged in both pairs of track-guiding elements 29. This arrangement is advantageous because the filter unit 10 is located at the floor of the transportation route 5 in direct vicinity to the source (the vehicle 6) of the ambient air pollutants. The filter unit 10 can be embodied here preferably as a passive system. It is however also possible to operate it (additionally, as needed) as an active system and to increase in this way the separation performance of the filter unit 10.

Figure 18:
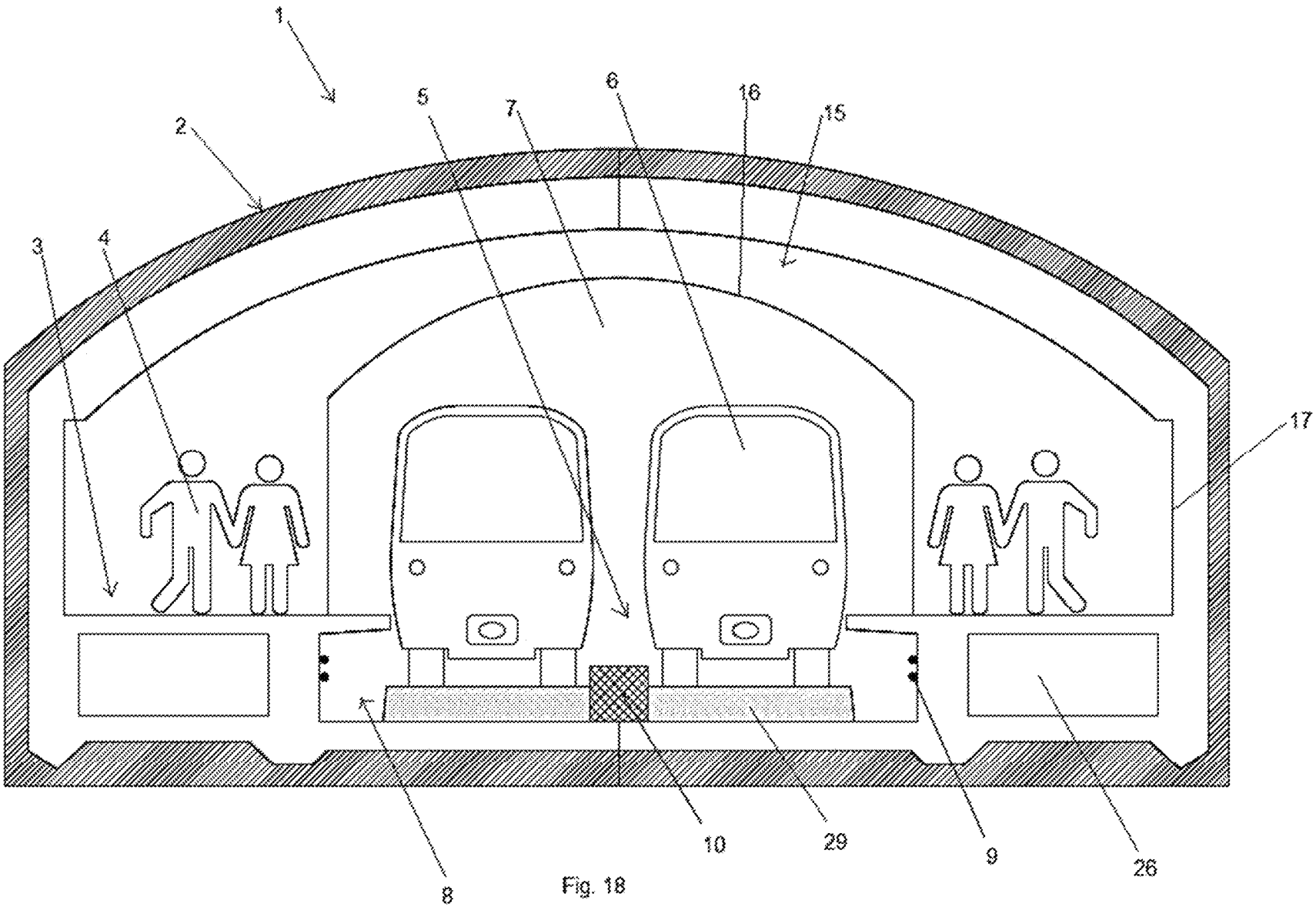
FIG. 18 shows a schematic section view of the tunnel train station according to an eighteenth embodiment.

FIG. 18 comprises, similar to FIG. 17, two neighboring pairs of track-guiding elements 29. The filter unit 10 is arranged here between the two pairs of track-guiding elements 29.

Figure 19:
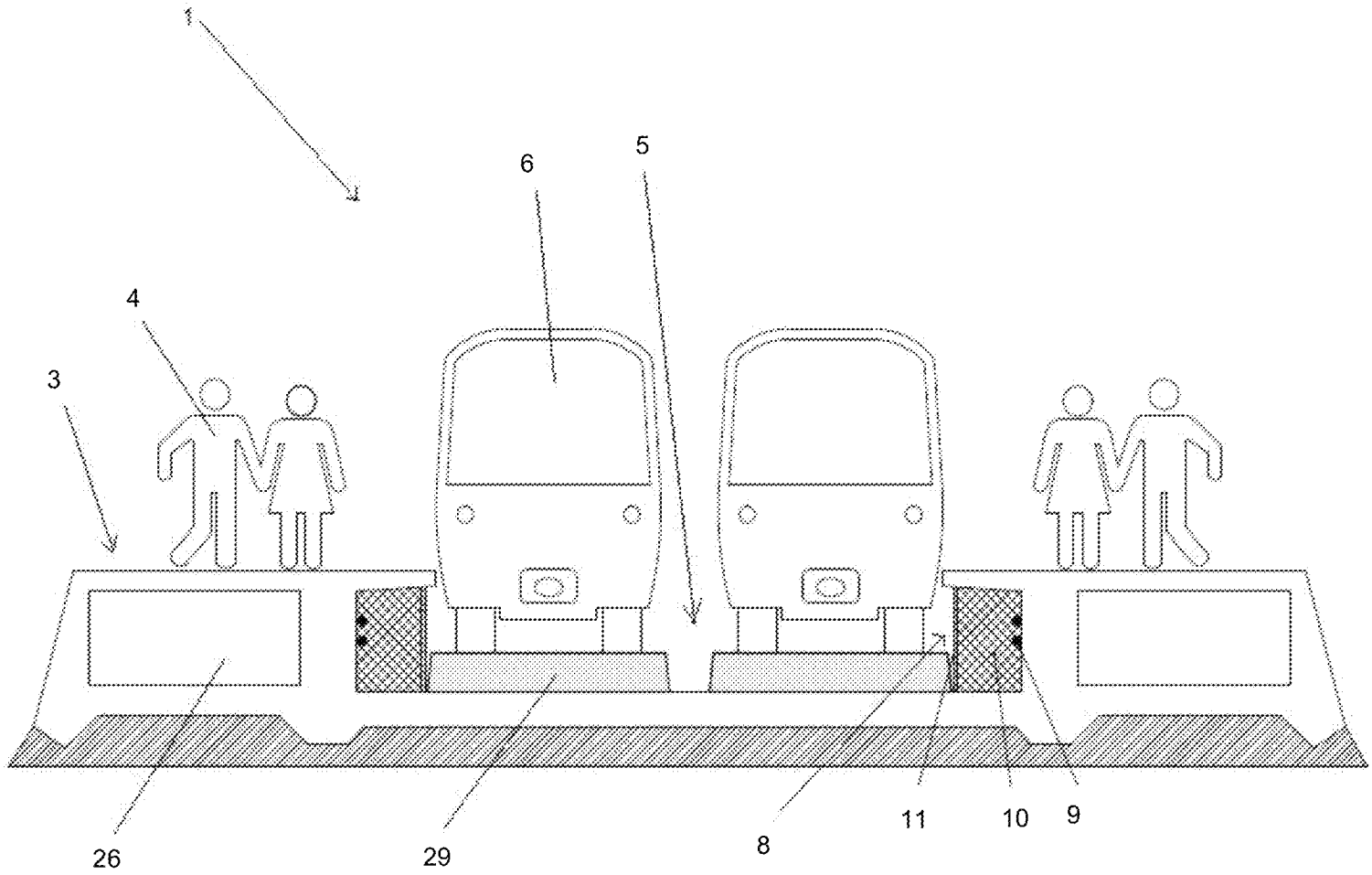
FIG. 19 shows a schematic section view of a train station.

In the illustrated embodiment of a train station 1 of FIG. 19, the filter unit 10 is arranged in the free space 8. This arrangement is particularly advantageous because the free space 8 is already present in most train stations 1 as the illustrated U-shaped molded concrete part. Furthermore, the free space 8 which is typically extending across the entire length of the public waiting area 3 makes available a substantially unobstructed outflow region for the filter unit 10. It can be operated e.g. as a passive system. The vehicles 6 moving into the train station 1 generate in this context a sufficient suction in the ambient air. The filter unit 10 can thus be flowed through e.g. in a length direction of the public waiting area 3. Other flow direction are however also conceivable. Also, the filter unit 10 can be operated (additionally) as an active system in order to increase the separation performance. The filter unit 10 is thus located also at the source of the ambient air pollutants. The efficiency of purification of the ambient air is optimized.

A further advantage of the arrangement of the filter unit 10 in the free space 8 is that it is protected from unauthorized access by persons 4 (and thus also from vandalism). Already existing installation space in the train station 1 is utilized. The clearance profile that is provided for the transportation route 5 is not infringed.

FIG. 19 shows also a protection device 11. It separates the free space 8 from the transportation route 5. Thus, the filter unit 10 is safely "enclosed" in the free space 8. This protection device 11 can be designed, for example, as a protective grid. This protective grid serves for protection of the filter unit 10 from environmental effects: on the one hand, it protects from vandalism by persons 4; on the other hand, it can also protect against damage of the filter unit 10 by animals (e.g. rodents) present in the transportation route 5. Also, damage by waste or the like that is swirled up by turbulence in the ambient air when a vehicle 6 is moving in/out is prevented. The mesh width of the protective grid is designed such that it causes only a negligibly small pressure loss in the environment of the filter unit 10. The filter unit 10 can be operated still as a passive system (additionally, as needed, as an active system).

FIG. 19 also shows a hollow space 26 in or under the public waiting area 3. This hollow space 26 can serve, for example, as a cable channel or channel for venting an air conditioning device. The filter unit 10 can be arranged in this hollow space 26 (not illustrated). Here, operated accordingly as an active system, it can suck in ambient air above the public waiting area 3 for purposes of purification.

In FIG. 19, finally a train station 1 is shown which comprises in the transportation route 5 a track-guiding element 29. In the illustrated embodiment, two pairs of track-guiding elements 29 are arranged adjacent to each other, spatially neighboring each other. The track-guiding element 29 can be e.g. a rail. Two track-guiding elements 29 of a pair of track-guiding elements 29 are arranged at a constant distance adjacent to each other. This distance defines a track gauge of the pair of track-guiding elements 29. Between the track-guiding elements 29 there is thus a free space available. This free space can be provided for receiving the filter unit 10 (not illustrated). This arrangement is advantageous because the filter unit 10 is located at the floor of the transportation route 5 in direct vicinity to the source (the vehicle 6) of the ambient air pollutants. The filter unit 10 can be operated here preferably as a passive system. However, it is also possible to operate it (additionally, as needed) as an active system and to increase in this way the separation performance of the filter unit 10. The filter unit 10 can also be arranged between the two pairs of track-guiding elements 29 (not illustrated).

Figure 20:
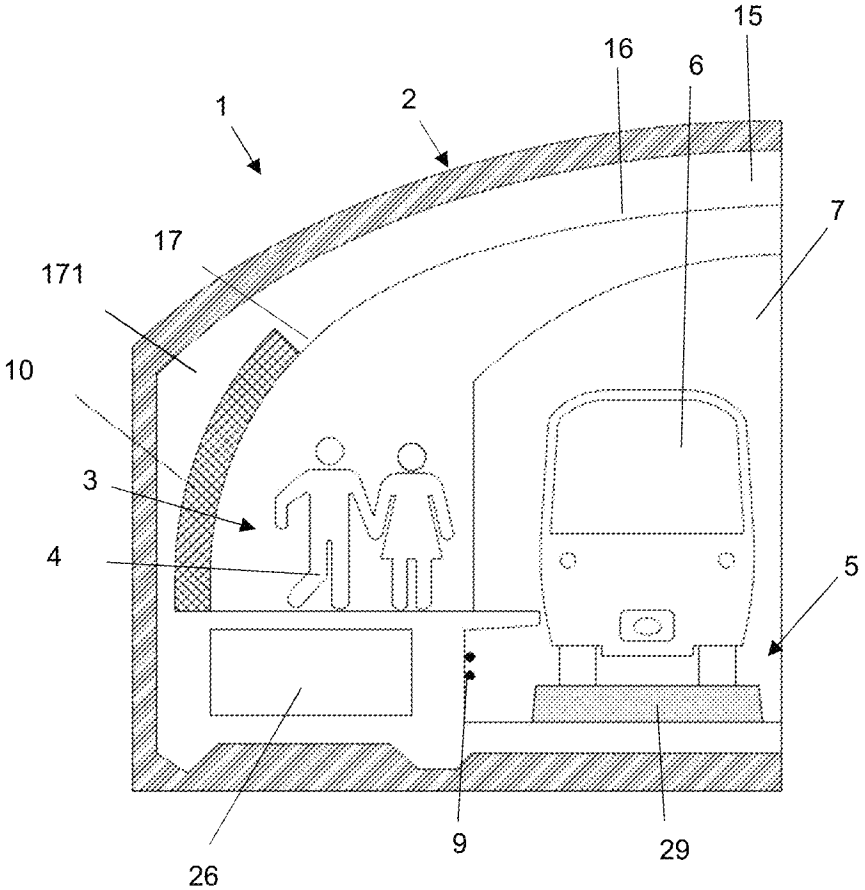
FIG. 20 shows a schematic section view of the tunnel train station according to the invention according to a nineteenth embodiment.

The embodiment of the train station 1 according to FIG. 20, which is embodied as a tunnel train station 1, shows it in a cross section view (in relation to a length extension of the transportation route 5). With respect to the arrangement of transportation route 5, public waiting area 3, and vehicle tunnel 7, it does not differ from the afore described embodiment of FIG. 6 in which the filter unit 10 also is received at least partially in a side wall 17 of the enclosure 2. The embodiment of FIG. 20 differs relative thereto in that the side wall 17 comprises a curvature in a plane that extends normal to a length extension of the transportation route 5. The curvature exists in very many tunnel train stations 1 and results due to the employed construction method (tunnel drill). The filter unit 10 is preferably completely integrated or embedded in the curved side wall 17 so that it does not require any space in the public waiting area 3. Between a building shell of the tunnel train station 1 or its enclosure 2 and a cladding, a gap 171 is present which is unused in conventional tunnel train stations 1. This installation space is suitable excellently for arranging the filter unit 10, as illustrated in the Figure. Suitably, the filter unit 10 is an active filter unit, i.e., a filter unit 10 with at least one blower for generating an air flow through at least one filter element. The filter unit 10 comprises in particular at least one air inlet opening and an air outlet opening that are facing toward the public waiting area 3, wherein the at least one filter element is arranged in fluid communication therebetween. The air outlet opening is advantageously arranged above the at least one air inlet opening, which contributes to a particularly effective ambient air purification because it is known that the pollutant concentration, in particular particulate matter concentration, in lower air layers is multiple times higher than in higher air layers. Alternatively or additionally, the air inlet opening can be present in a region of the partition device that is close to the floor.

What is claimed is:

1. A train station comprising:

at least one transportation route for traffic of vehicles, wherein the at least one transportation route comprises a vehicle tunnel;

at least one public waiting area arranged adjacent to the at least one transportation route;

an enclosure that partially encloses the at least one public waiting area and the at least one transportation route, wherein the enclosure comprises at least one side wall;

at least one ambient air purification arrangement configured to purify ambient air and comprising one or more filter units configured to separate solid, liquid or gaseous ambient air pollutants from the ambient air;

wherein the one or more filter units are arranged at and/or in the at least one side wall of the enclosure, wherein the at least one side wall of the enclosure comprises a curvature viewed in a plane positioned normal to a length extension of the at least one transportation route, and wherein the one or more filter units comprise a curvature corresponding to the curvature of the at least one side wall of the enclosure.

2. The train station according to claim 1, wherein each of the one or more filter units arranged at and/or in the at least one side wall comprises at least one air inlet opening facing the at least one public waiting area and further comprises at least one air outlet opening facing the at least one public waiting area, wherein the one or more filter units are configured to be supplied with the ambient air through the at least one air inlet opening and configured to discharge purified air through the at least one air outlet opening.

3. The train station according to claim 1, wherein the enclosure comprises a ceiling region, wherein the one or more filter units include a filter unit arranged in the ceiling region.

4. The train station according to claim 3, wherein the filter unit arranged in the ceiling region is arranged between a ceiling of the enclosure and an overhead contact line of the transportation route.

5. The train station according to claim 1, further comprising a partition device, wherein the at least one public waiting area is separated by the partition device from the at least one transportation route, and wherein the one or more filter units are arranged at and/or in the partition device.

6. The train station according to claim 5, wherein the partition device is an access control device, wherein the access control device comprises at least one access control door configured to open the at least one public waiting area in a person exchange state toward the at least one transportation route.

7. The train station according to claim 1, wherein the at least one public waiting area comprises at least one station platform extending parallel to the at least one transportation route, wherein the at least one station platform comprises at least one overhang region extending at least partially across a free space, wherein the one or more filter units include a filter unit arranged in a region.

8. The train station according to claim 7, wherein the free space is closed off by a protection device with respect to the at least one transportation route.

9. The train station according to claim 8, wherein the protection device is a protective grid.

10. The train station according to claim 1, further comprising a column-shaped structural element arranged in the at least one public waiting area, wherein the one or more filter units include a filter unit arranged in the column-shaped structural element.

11. The train station according to claim 10, wherein the column-shaped structural element is embodied as a seat for a person waiting in the at least one public waiting area.

12. The train station according to claim 1, further comprising a stairway, wherein the one or more filter units include a filter unit arranged at the stairway.

13. The train station according to claim 12, wherein the stairway is a self-supporting stairway and the filter unit arranged at the stairway is arranged underneath the self-supporting stairway.

14. The train station according to claim 1, further comprising an escalator, wherein the one or more filter units include a filter unit arranged at the escalator.

15. The train station according to claim 14, wherein the filter unit arranged at the escalator is arranged in a region between said escalator and a neighboring escalator.

16. The train station according to claim 1, wherein the at least one transportation route comprises one or more track-guiding elements, wherein the one or more filter units include a filter unit arranged on the at least one transportation route.

17. The train station according to claim 16, wherein the one or more track-guiding elements include two neighboring track-guiding elements, wherein the filter unit arranged on the at least one transportation route is arranged between the two neighboring track-guiding elements.

18. The train station according to claim 16, wherein the one or more track-guiding elements include two pairs of track-guiding elements, wherein the filter unit arranged on the at least one transportation route is arranged in an intermediate space between the two pairs of track-guiding elements.

19. The train station according to claim 1, wherein the at least one public waiting area comprises a hollow space, wherein the one or more filter units include a filter unit arranged in the hollow space.

20. The train station according to claim 19, wherein the hollow space is a cable guiding channel and/or a venting channel.

21. The train station according to claim 1, wherein the ambient air purification arrangement comprises at least one sensor device configured to detect a vehicle moving into or out of the train station and/or configured to detect a degree of ambient air contamination, wherein the at least one sensor device is configured to activate or deactivate the one or more filter units based on detecting a vehicle moving into or out of the train station and/or based on detecting a limit value of the degree of ambient air contamination.

* * * * *